US006102509A

United States Patent [19]

Olson

[11] Patent Number: 6,102,509

[45] **Date of Patent: *Aug. 15, 2000**

[54] ADAPTIVE METHOD FOR HANDLING INKJET PRINTING MEDIA

[75] Inventor: Allan G. Olson, Camas, Wash.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/652,720

[22] Filed: May 30, 1996

[51] Int. Cl.[7] ..... B41J 25/308; B41J 11/20; B41J 23/34

[52] U.S. Cl. ..... 347/8; 400/58; 400/59; 400/185

[58] Field of Search ..... 347/8; 400/58, 400/59, 185

[56] References Cited

U.S. PATENT DOCUMENTS

| | | | |
|---|---|---|---|
| 4,306,245 | 12/1981 | Kasugayama et al. | 346/140 |
| 4,843,338 | 6/1989 | Rasmussen et al. | 347/8 |
| 4,872,026 | 10/1989 | Rasmussen et al. | 347/56 |
| 4,927,277 | 5/1990 | Niikawa | 400/56 |
| 5,000,594 | 3/1991 | Beehler et al. | 400/569 |
| 5,135,321 | 8/1992 | Olsen et al. | 400/605 |
| 5,192,141 | 3/1993 | Chung et al. | 400/56 |
| 5,316,285 | 5/1994 | Olson et al. | 271/122 |
| 5,326,090 | 7/1994 | Hock et al. | 271/162 |
| 5,466,079 | 11/1995 | Quintana | 400/579 |
| 5,468,076 | 11/1995 | Hirano et al. | 400/59 |
| 5,510,815 | 4/1996 | Linder et al. | 347/8 |
| 5,557,306 | 9/1996 | Fukushima et al. | 347/33 |
| 5,559,538 | 9/1996 | Nguyen et al. | 347/32 |
| 5,570,959 | 11/1996 | Moriwaki | 400/56 |
| 5,581,289 | 12/1996 | Firl et al. | 347/104 |
| 5,624,196 | 4/1997 | Jackson et al. | 400/625 |

*Primary Examiner*—John Barlow
*Assistant Examiner*—An H. Do
*Attorney, Agent, or Firm*—Flory L. Martin

[57] ABSTRACT

An adaptive method for handling media is provided for an inkjet printing mechanism having a printhead that prints on media in a printzone. A drive motor, a spacing adjuster, a controller storing a tolerance adjust value, and a media support member are provided, with the support member defining a printhead-to-media spacing in the printzone. The tolerance value is summed with a value selected for the type of media or image to determine a total motor drive value. In a coupling step, the motor is operatively coupled to the support member using the spacing adjuster. Following the coupling step, in an adjusting step, the printhead-to-media spacing is selectively adjusted by the driving spacing adjuster with the motor for the total drive value. A method is provided of accommodating manufacturing tolerance variations accumulated during assembly of an inkjet printing mechanism having a printhead that prints on media in a printzone.

13 Claims, 15 Drawing Sheets

300

374
Begin Printing Routine
382
388
380
384
Uniform Media Thickness?
NO
386
388
YES
390
Hold Pivot in Print Position
392
394
Finish Printing Routine
396
398
400
Begin Media Discharge Routine
402
404
Move Carriage to Engage Shift Lever to Couple Adaptor Cam to Motor
406
408
Optional: Return Carriage to Service Station
409
410
412
414
Rotate Drive Rollers to Discharge Media to Output Tray
Rotate Adaptor Cam to Lower Pivot to Rest Position
416

ADAPTIVE METHOD FOR HANDLING INKJET PRINTING MEDIA

FIELD OF THE INVENTION

The present invention relates generally to printing mechanisms, and more particularly to an adaptive method for handling inkjet printing media to accurately move and print upon individual sheets of media in a printzone of an inkjet printing mechanism.

BACKGROUND OF THE INVENTION

Inkjet printing mechanisms use cartridges, often called "pens," which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To print an image, the printhead is scanned back and forth across a printzone above the sheet, with the pen shooting drops of ink as it moves. By selectively energizing the resistors as the printhead moves across the sheet, the ink is expelled in a pattern on the print media to form a desired image (e.g., picture, chart or text). The nozzles are typically arranged in one or more linear arrays. If more than one, the two linear arrays are usually located side-by-side on the printhead, parallel to one another, and perpendicular to the scanning direction. Thus, the length of the nozzle arrays defines a print swath or band. That is, if all the nozzles of one array were continually fired as the printhead made one complete traverse through the printzone, a band or swath of ink would appear on the sheet. The width of this band is known as the "swath width" of the pen, the maximum pattern of ink which can be laid down in a single pass. Any variation in the media-to-printhead spacing along the length of the nozzle array may yield visually acceptable deviations in print quality. There are a variety of different problems that make it difficult to always achieve consistent and accurate media-to-printhead spacing.

As a preliminary matter, there is a term of art used by inventors skilled in this art that will speed the reading if used herein, and it is "pen-to-paper spacing," often abbreviated as "PPS" or "PPS spacing." In the English language of the inventor, "pen-to-paper spacing" or "PPS" is easier to pronounce than the more technically explicit term "media-to-printhead spacing," and for this reason "pen-to-paper spacing" or "PPS" are used herein. During prototype testing and development, inventors use vast amounts of media, so the most plentiful and economical media, plain paper is used. Indeed, the short-hand term "pen-to-paper spacing" is a logical selection of terminology, although it must be understood that as used herein, this term encompasses all different types of media, unless specified otherwise in describing a particular type of media. Thus, "pen-to-paper spacing" (PPS) defines the spacing between the inkjet cartridge printhead and the printing surface of the media, which may be any type of media, such as plain paper, specialty paper, card-stock, fabric, transparencies, foils, mylar, etc. Having dispensed with preliminary matters, the discussion of the problems encountered in this art in maintaining an accurate PPS now continues.

First, there is a tendency for some graphic and photographic type images to saturate the media with ink, causing an undesirable effect known in the art as "cockle." The term "cockle" refers to the tendency of media, such as paper, to uncontrollably bend or buckle as the wet ink saturates the fibers of the media and causes them to expand. This buckling or cockling causes the media to uncontrollably bend either downwardly away from the printhead, or upwardly toward the printhead, with either motion undesirably changing the PPS spacing and leading to poor print quality. Moreover, upward buckling may be extreme enough to cause the media to actually contact the printhead, which may clog a nozzle and/or smear ink on the media, damaging the image.

Second, there are variations in the thickness of the print media which also affect the PPS spacing. For example, envelopes, poster board and fabric are typically thicker than plain paper or a transparency. The thicker media decreases the spacing from the printhead to the printing surface, and as with cockle, in the worst case, this reduced spacing could lead to contact of the printhead with the media, possibly damaging either the printhead or the image. Furthermore, these various media thicknesses also offer challenges to an automatic feed system, which must pick the top sheet from a stack of media, and then accurately feed it into the print zone.

One earlier media handling system tried to accommodate thicker envelopes, using a width sensor that detected media narrower than about 12 cm (4.5 in). Upon detecting this narrow media, a mechanical arm opened an inlet port on the media handling system to a much wider gap than normal to prevent ink smear on the envelope. Unfortunately, the assumption envelope was being printed just because the media width was narrow completely ignored the printing of postcards by a user. Thus, when printing postcards the print quality was severely degraded by the greater PPS spacing. Moreover, there was no provision for the user to defeat this mechanical widening of the gap when postcards where printed.

The earlier media handling systems lacked any ability to adjust the PPS spacing, other than adjustments made during initial assembly at the factory. Manufacturing adjustments are required to accommodate the large number of parts whose various tolerances accumulate and lead to a large degree of variability around the nominal spacing value. One earlier method involved the rotation of a helical cam, and the tightening of an adjustment screw to fasten the cam in place. Unfortunately, errors may occur during manufacturing, for example, from human error in reading a dial indicator measuring device or other display. Furthermore, the act of tightening the adjustment screw caused various mechanical stresses on the component parts. Additionally, physical access to the adjustment cam and screw had to be provided for in the mechanical design of the printer. Furthermore, this manual adjustment may occur when the printing mechanism was only partially assembled, so the addition of other parts to the printer mechanism could warp the spacing adjustment. Any of these inaccuracies in the PPS spacing occurring during manufacture could result in degraded print quality for the entire life of the printer.

Beyond the PPS spacing issue, the earlier media handling systems have suffered a variety of other disadvantages. Many of these earlier systems required a multitude of separate parts, for picking sheets of media from a stack, feeding the media through the print zone, and then depositing the printed sheet in an output tray. For example, one earlier design required 15–17 separate parts, which contributed significantly to the overall complexity and cost of the printing mechanism, not only in the actual cost of the parts themselves, but also in labor time required for their assembly. Additionally, many of these earlier media handling systems used spring loaded parts, which at some point during printing would snap the parts back into place; a noisy operation indeed. Most customers in the home or office environment want quieter printers, so this noise from return springs and the associated noise of the parts colliding with one another in the earlier designs was undesirable.

Given the criticality of the pen-to-paper spacing, the desire for higher print quality, which typically implies a closer spacing, as well as the ability to handle different types of media (e.g., envelopes, plain paper, card stock, etc.) and different images (e.g., text vs. graphic vs. photographic), it would be desirable to adjust the PPS spacing automatically during use. Such an automatic adjustment would also aid manufacturing, particularly if it could be implemented in a media handling system having fewer and quieter components.

SUMMARY OF THE INVENTION

According to one aspect of the invention, an adaptive method of printing using an inkjet printing mechanism having a printhead that prints on media in a printzone is provided as including the step of providing a drive motor and a spacing adjuster. Also in the providing step, a media support member is provided, with the support member defining a printhead-to-media spacing in the printzone between the printhead and media when supported thereby. In a coupling step, the motor is operatively coupled to the support member using the spacing adjuster. Following the coupling step, in an adjusting step, the printhead-to-media spacing is selectively adjusted by the driving spacing adjuster with the motor.

According to another aspect of the invention, a method is provided of accommodating manufacturing tolerance variations accumulated during assembly of an inkjet printing mechanism having a printhead that prints on media in a printzone. The method includes the step of assembling a media handling system for an inkjet printing mechanism from plural components each having unique dimensions ranging between maximum and minimum limits. These components include a printhead, a drive motor, a spacing adjuster, a media support member that defines a printhead-to-media spacing in the printzone between the printhead and media when supported thereby. When assembled, the system has a manufactured printhead-to-media spacing. In a measuring step, the manufactured printhead-to-media spacing is measured, then compared in a comparing step, with a nominal value for printhead-to-media spacing to determine a spacing difference therebetween. In a determining step, the amount to drive the motor that corresponds to the determined spacing difference is determined, for instance, by referring to a look-up table correlating these values. In a coupling step, the motor is operatively coupled to the support member using the spacing adjuster. Following the coupling step, in an adjusting step, the printhead-to-media spacing is selectively adjusted by the driving spacing adjuster with the motor for the determined amount to arrive at an adjusted spacing.

According to a further aspect of the invention, an adaptive method of printing using an inkjet printing mechanism having a printhead that prints on media in a printzone is provided as including the step of providing a drive motor and a spacing adjuster. Also in the providing step, a media support member is provided, with the support member defining a printhead-to-media spacing in the printzone between the printhead and media when supported thereby. The providing step also includes providing a controller having a memory portion with a tolerance adjust value stored therein. In a selecting step, a desired printhead-to-media spacing is selected, along with an amount to drive the motor that corresponds to the desired printhead-to-media spacing. In a summing step, the tolerance adjust value and the selected amount to drive the motor are summed together to arrive at a total motor drive value. In a coupling step, the motor is operatively coupled to the support member using the spacing adjuster. Following the coupling step, in an adjusting step, the printhead-to-media spacing is selectively adjusted by the driving spacing adjuster with the motor for the total motor drive value.

An overall goal of the present invention is to provide an adaptive method for handling media to accurately move individual sheets of media and envelopes through a printzone of an inkjet printing mechanism, as well as long Z-folded strips of banner media.

Another goal of the present invention is to provide an adaptive method of adjusting printhead-to media spacing that may be automatically implemented, not only during initial assembly, but also during operation to meet the printing needs of different types of media and images.

A further goal of the present invention is to provide an economical method of operating an inkjet printing mechanism which optimizes the print quality of an image and which operates quietly, with minimal user intervention.

BRIEF DESCRIPTION OF THE DRAWINGS

FIG. 7 shows the drive mechanism in a kick position for ejecting media, which also corresponds to a rest position and a start position for picking fresh media;

FIG. 8 shows a transition portion of operation of the drive mechanism, where the printhead carriage engages the shift lever (not shown) to begin the media pick routine;

FIG. 9 shows.,the drive mechanism beginning to pick a sheet of media;

FIG. 10 shows the drive mechanism during an intermediate stage of picking the sheet;

FIG. 11 shows the drive mechanism during a final stage of picking the sheet, prior to transitioning to the initial position of FIG. 7;

FIG. 12 shows the drive mechanism in an initial position for beginning normal printing instance on plain paper;

FIG. 13 shows the drive mechanism during a media to printhead spacing adjustment portion of operation; and FIG. 14 shows a transition portion of operation of the drive mechanism.

DETAILED DESCRIPTION OF THE PREFERRED EMBODIMENTS

Figure 1:
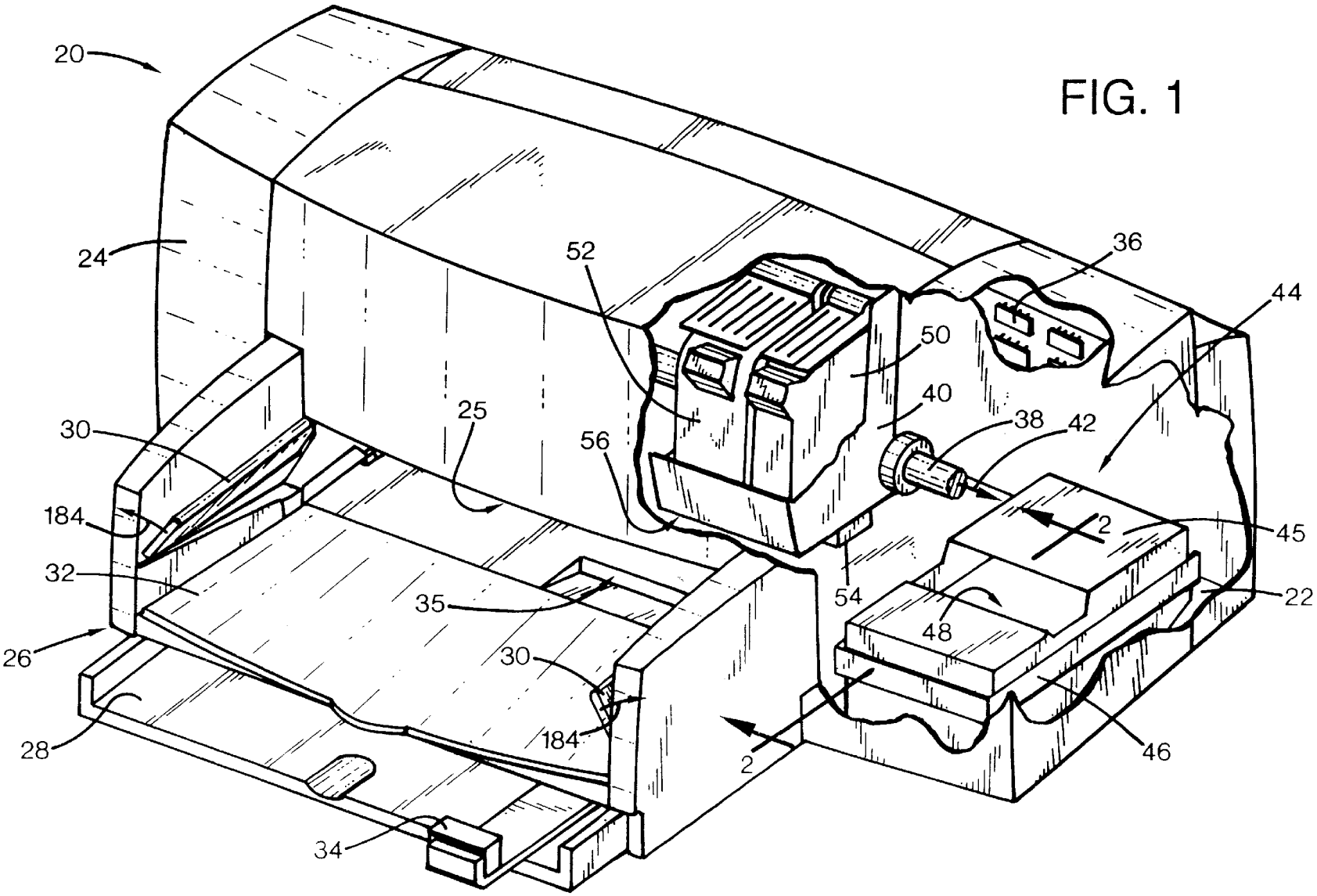
FIG. 1 , is a fragmented perspective view of one form of an inkjet printing mechanism employing one form of an adaptive media handling system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a print zone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of motor-driven paper drive rollers described in detail below (FIGS. 2–13) may be used to move the print media from tray 28 into the print zone 25 for printing. After printing, the sheet then lands on a pair of retractable output drying wing members 30, shown extended to receive a the printed sheet. The wings 30 momentarily hold the newly printed sheet above any previously printed sheets still drying in an output tray portion 32 before retracting to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and an envelope feed slot 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is supported by the chassis 22 to slideably support an inkjet carriage 40 for travel back and forth across the print zone 25 along a scanning axis 42 defined by the guide rod 38. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 36. For instance, a carriage drive gear and DC motor assembly may be coupled to drive an endless belt secured in a conventional manner to the pen carriage 40, with the motor operating in response to control signals received from the printer controller 36. To provide carriage positional feedback information to printer controller 36, an optical encoder reader may be mounted to carriage 40 to read an encoder strip extending along the path of carriage travel.

The carriage 40 is also propelled along guide rod 38 into a servicing region, as indicated generally by arrow 44, located within the interior of the casing 24. The servicing region 44 houses a service station 45, which may provide various conventional printhead servicing functions. For example, a service station frame 46 may hold a conventional or other mechanism that has caps to seal the printheads during periods of inactivity, wipers to clean the nozzle orifice plates, and primers to prime the printheads after periods of inactivity. Such caps, wipers, and primers are well known to those skilled in the art. A variety of different mechanisms may be used to selectively bring the caps, wipers and primers (if used) into contact with the printheads, such as translating or rotary devices, which may be motor driven, or operated through engagement with the carriage 40. For instance, suitable translating or floating sled types of service station operating mechanisms are shown in U.S. Pat. Nos. 4,853,717 and 5,155,497, both assigned to the present assignee, Hewlett-Packard Company. A rotary type of servicing mechanism is commercially available in the DeskJet® 850C and 855C color inkjet printers, sold by Hewlett-Packard Company, the present assignee. In FIG. 1 a spittoon portion 48 of the service station is shown as being defined, at least in part, by the service station frame 46.

In the print zone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. The printheads 54, 56 typically include substrate layer having a plurality of resistors which are associated with the nozzles. Upon energizing a selected resistor, a bubble of gas is formed to eject a droplet of ink from the nozzle and onto media in the print zone 25. The printhead resistors are selectively energized in response to enabling or firing command control signals, which may be delivered by a conventional multi-conductor strip (not shown) from the controller 36 to the printhead carriage 40, and through conventional interconnects between the carriage and pens 50, 52 to the printheads 54, 56.

Adaptive Media Handling System

Figure 2:
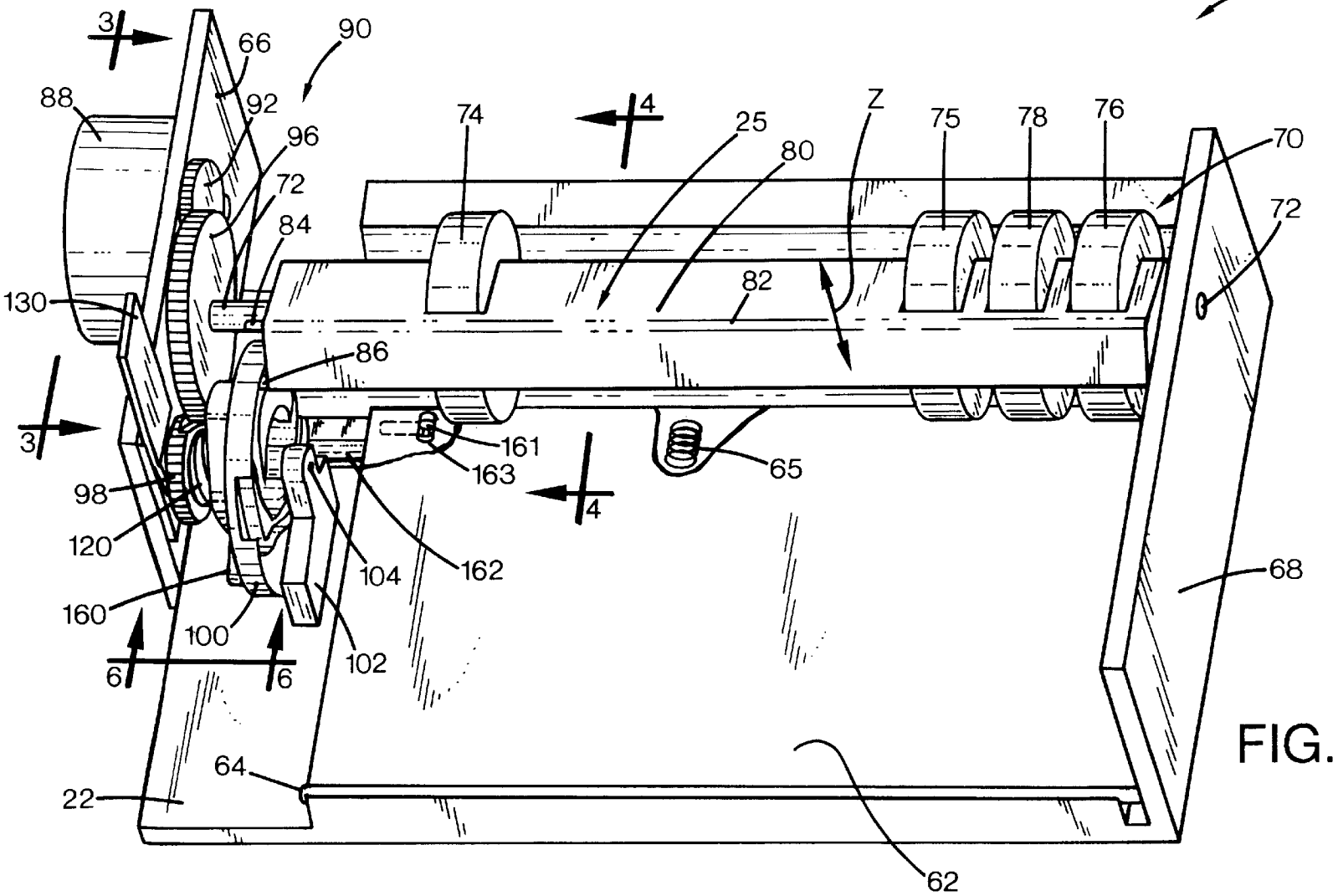
FIG. 2 is a fragmented perspective view of the adaptive media handling system of FIG. 1 shown removed from the casing of the printing mechanism.

FIG. 2 shows an adaptive media transport system 60, constructed in accordance with the present invention, which forms a portion of the print media handling system 26. The adaptive transport system 60 pulls a sheet of print media from the feed tray 28, delivers it to the print zone 25, and after printing deposits the sheet on the output drying wings 30, shown in FIG. 1. The adaptive system 60 includes several components attached to the chassis 22, including a pressure plate 62 which is pivoted along a front edge to the chassis 22 by a hinge member 64. A rear edge of the media lifter, lifter plate, or pressure plate 62 is upwardly biased away from the chassis 22 by a compression spring member 65. One or more compression springs 65 may be used between the pressure plate 62 and the chassis 22, although for the purposes of illustration only one such spring is shown. Moreover, it is apparent that leaf springs or other biasing devices may be used to urge the rear edge of the pressure plate 62 upwardly and away from the lower portion of chassis 22.

The chassis 22 has two opposing upright walls 66 and 68. The transport system 60 includes a media advance or drive roller system 70 suspended by an axle 72 between the chassis walls 66 and 68. The roller system 70 preferably includes three elastomeric drive rollers or tires 74, 75 and 76. Two of the drive tires 75, 76 are clustered together along one edge of the print zone, adjacent the envelope feed slot 35 (FIG. 1) to evenly pull a business-sized envelope through the feed slot and into the print zone 25.

In a preferred embodiment, the drive roller system 70 also includes a pick tire 78, which is preferably of a softer durometer elastomer, and of a slightly smaller diameter than the drive tires 74–76. The drive tires 74–76 and the pick tire 78 may be of the same or different type of elastomer, such as of a rubber or equivalent material known to those skilled in the art, with one preferred elastomer being ethylene polypropylene diene monomer (EPDM) for both drive and pick tires 74–78. The durometer of the drive tires 74–76 may be selected from the range of 45–70, or more preferably 55–65, with a preferred nominal value being 60, all measured on the Shore A scale. The softer durometer of the pick tire 78 may be selected from the range of 25–45, or more preferably 30–40, with a preferred nominal value being about 35, also measured on the Shore A scale. Use of a softer durometer pick tire 78 allows for more frictional forces to be developed between the media and the outer periphery of the pick tire 78, with these additional frictional forces assisting in pulling the media into the transport system 60. By locating the pick tire 78 between the envelope drive rollers 75, 76, the pick tire assists not only in picking sheets of paper from the input tray 28, but also in picking and feeding envelopes received through slot 35.

Also suspended in part from the chassis side wall 68, and running parallel to the drive system axle 72, is a media support member or pivot 80. The pivot 80 has a leading media support edge 82, which is adjustable in height as indicated by the double-headed arrow Z in a manner described further below. Extending outwardly from the left side of pivot 80 (as seen in FIG. 2) are two cam follower members, such as, a pick cam follower pin 84, and a media spacing adjust cam follower or PPS adjust pin 86.

A drive motor 88 is attached to an outboard side of the chassis upright wall 66. As shown in FIGS. 2–6, the motor 88 forms a portion of a drive system or mechanism 90. The drive mechanism 90 powers the drive roller system 70, the pressure plate 62, and the pivoting media support 80, all of which form portions of the adaptive media transport system 60. The motor 88 has an output shaft 91 that supports a pinion gear 92. The pinion gear 92 engages and drives a roller gear 94, which is coupled to the drive roller axle 72. An intermediate or transfer gear 96 is also coupled to the axle 72. As described further below, the transfer gear 96 may be selectively placed in engagement with a cam drive gear 98 to drive an adaptive spacing adjust member, such as a dual sided cam member 100. A cam support 102 extends upwardly from the chassis 22 to support a cam axle 104. Both the cam 100 and the cam gear 98 ride on axle 104.

Figure 5:
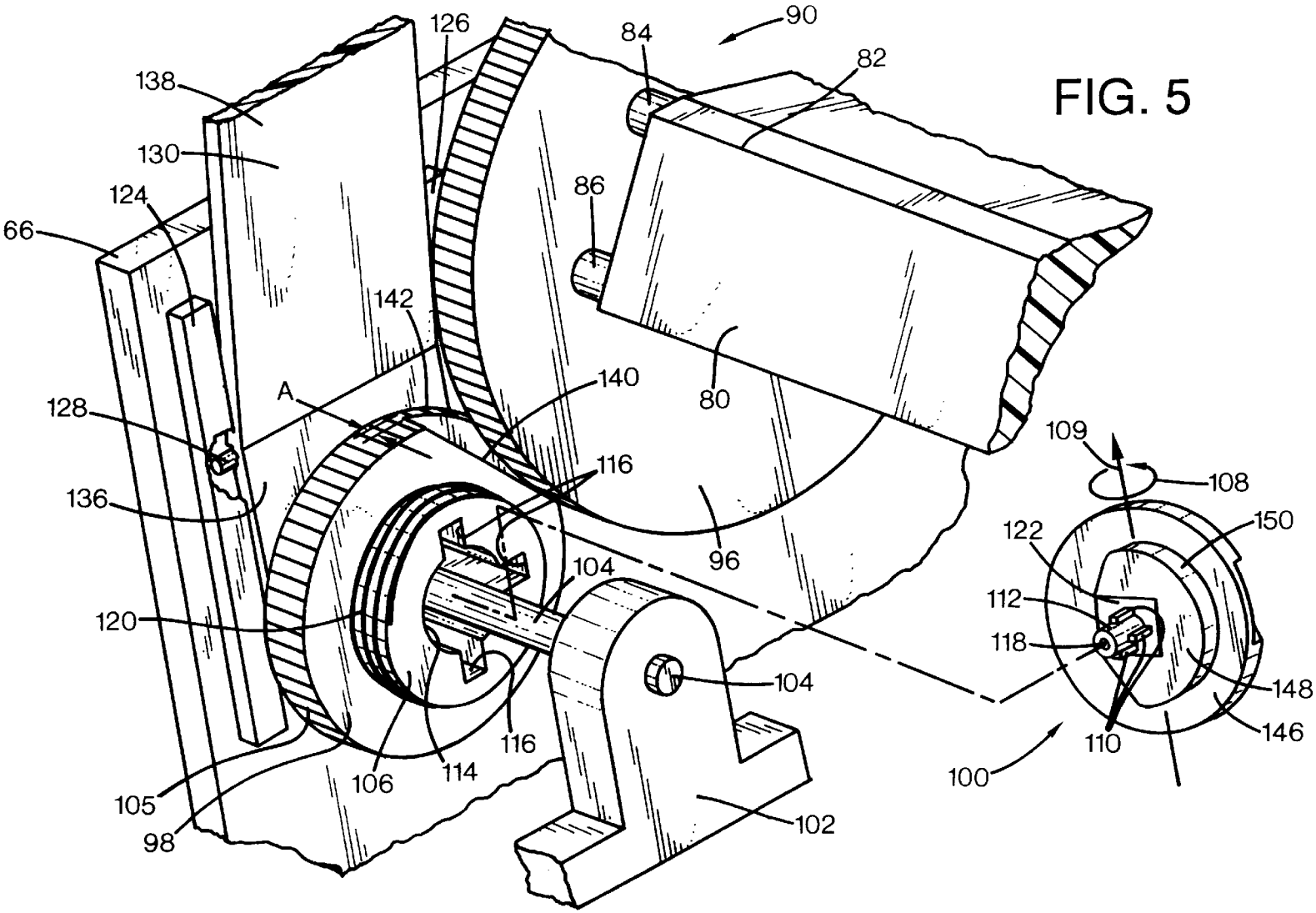
FIG. 5 is an enlarged perspective, partially exploded view of a portion of the in-board side of the media drive mechanism, with one component (100) shown reduced in size and rotated in the view around a vertical axis to better illustrate its coupling with the other components.

The cam gear 98 is designed to drive the cam 100 during paper pick, discharge, and pen-to-paper (PPS) spacing adjustment portions of operation. As shown in detail in FIG. 5, the cam gear 98 has a large outer rim having pick teeth 105 around the majority of its periphery. A raised land 106 is substantially concentric with the toothed outer rim 105 and extends inboardly therefrom. In the view of FIG. 5, to better illustrate the interaction of the cam gear 98 and cam 100, cam 100 is shown removed from shaft 104, as indicated by the line of alternating long and short dashes. Moreover, the cam 100 is shown rotated counterclockwise from its position in operation, as indicated by the curved arrow 108, with this rotation being around a vertical axis 109. For convenience, the cam 100 is shown reduced in size by approximately 50–60% with respect to the remaining components in FIG. 5, but is clearly shown in uniform relative proportions in all of the other figures.

The adaptor cam 100 has a series of splines 110 extending outwardly from a boss or sleeve portion 112. The sleeve 112 and splines 110 fit within a bore 114 having a series of grooves 116 formed along the interior of the cam gear 98. The sleeve 112 has a bore 118 which rides along axle 104. A compression spring 120 is coiled around the raised land 106 of cam gear 98 and rides in part against a land portion 122 of cam 100.

Figure 3:
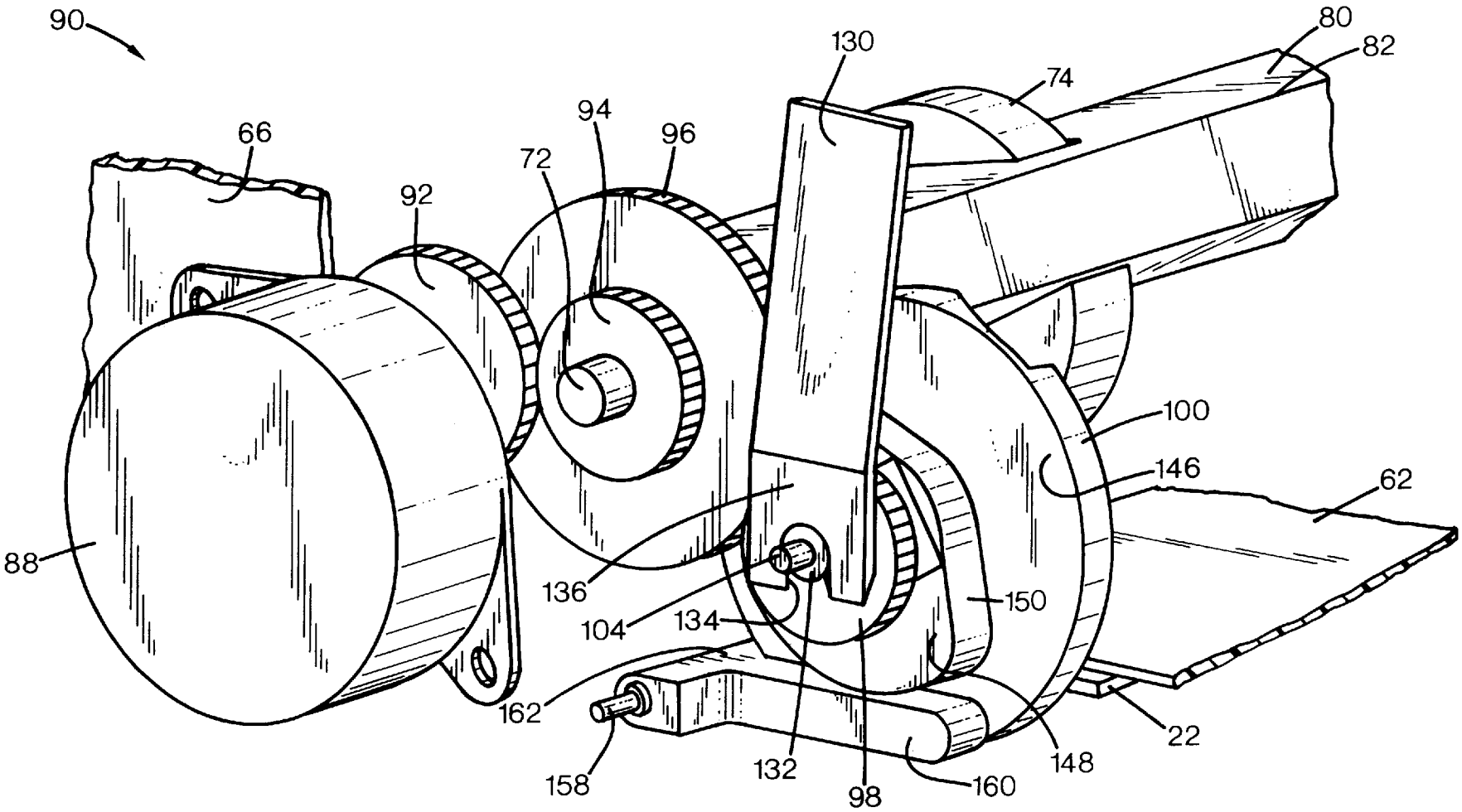
FIG. 3 is a fragmented, enlarged perspective view taken along line 3—3 of FIG. 2, showing the, out-board side of one form of a media drive mechanism of the present invention.
Figure 6:
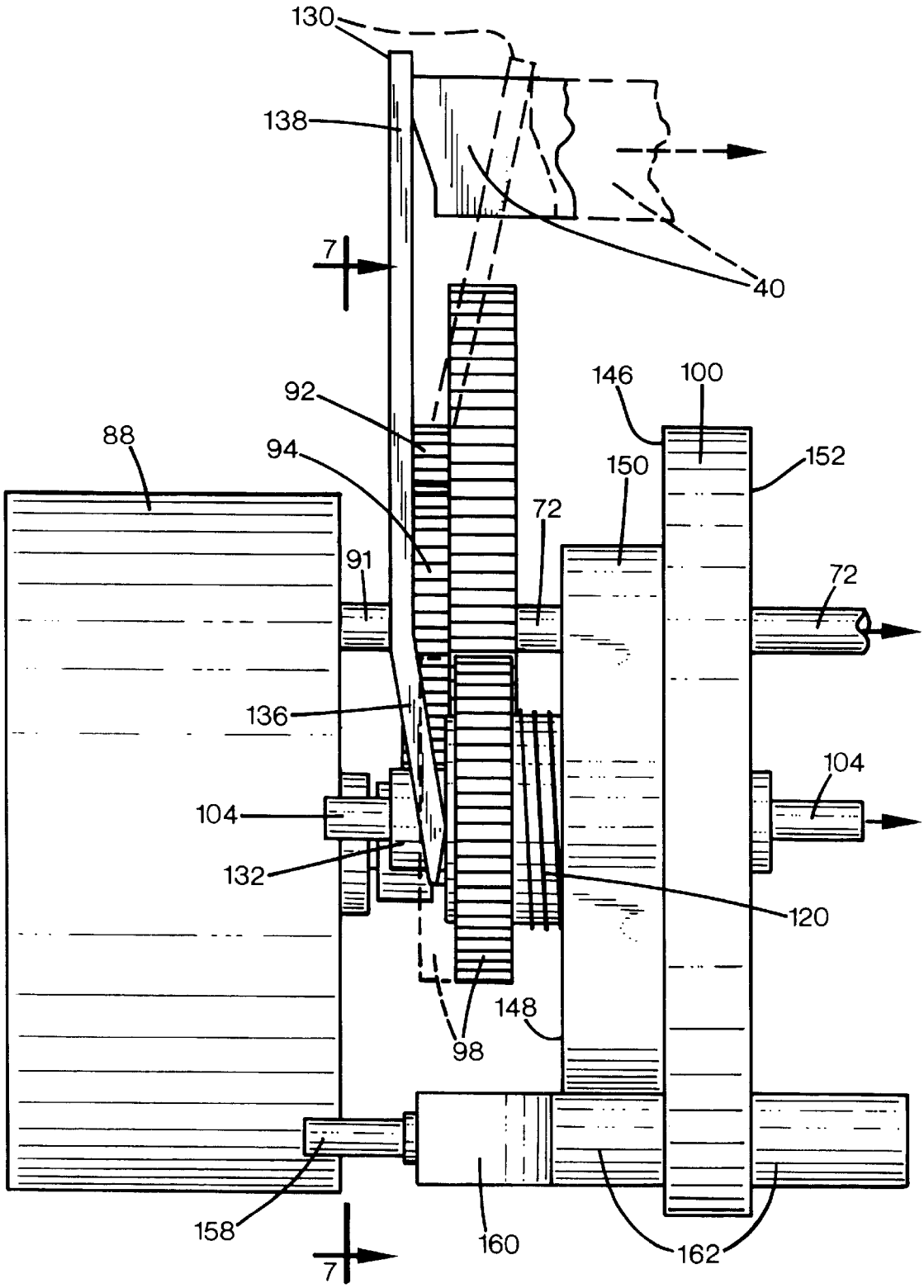
FIG. 6 is a fragmented, enlarged front elevational view taken along line 6—6 of FIG. 2, also showing a portion of the printhead carriage engaging a shift lever member of the media drive mechanism.

Two guide ribs 124 and 126 are located along the interior surface of the chassis wall 66. As shown in FIG. 5, a pair of pivot pins, such as pin 128, extend inwardly from the ribs 124 and 126 to support a clutch mechanism or shift lever 130. As shown in FIG. 3, the outboard side of the cam gear 98 includes a raised disk portion 132, which is received within a U-shaped channel 134 defined by a lower extremity 136 of the shift lever 130. FIG. 6 shows an upper portion 138 of lever 130 being selectively engaged by a portion of the printhead carriage 40, to move the lever from the dashed line position to the solid line position (also shown in FIG. 4). The upper and lower portions 136, 138 of lever 130 are not coplanar, but instead are joined together at an obtuse angle, for instance, such as shown in FIG. 6. Thus, when the lever upper portion 138 is moved to the left in the views, the lever 130 pivots at pins 128 to force the lever lower portion 136 against the cam gear 98. Pushing the cam gear 98 toward the cam 100 compresses spring 120, and causes full engagement of the total width of teeth 105 with the teeth of the transfer gear 96. As the carriage 40 moves away from lever 130, for instance to print or to service the printheads 54, 56, the tension between the teeth of gears 96 and 105 maintains compression of the spring and full engagement of the gears as shown in solid lines in FIG. 6.

As shown in FIG. 5, a chordal cut has been made through a portion of the cam gear teeth 105, leaving a lost motion land 140 and a narrow track of spacing teeth 142 adjacent thereto, having a width A as indicated in FIG. 5. The frictional forces between the narrow teeth 142 and the teeth of transfer gear 96 are not sufficient to maintain compression of spring 120. Without assistance by lever 130, the force of spring 120 pushes the cam gear 98 axially in an outboard direction, to the position indicated by dashed lines in FIG. 6, so the teeth of gear 96 rotate over the lost motion land region 140 and the cam gear 98 remains in a fixed rotational position. Thus, in this lost motion region, the cam gear 98 and cam 100 are uncoupled from the drive motor 88. To rotate the cam 100 in this lost motion region, the carriage 40 must push lever 130 to engage the narrow teeth 142 with the transfer gear. Thus, the total travel of the cam gear 98 when pushed away from cam 100 by spring 120 is slightly greater than the width A of teeth 142. Use of this lost motion region and the narrow band of teeth 142 are described in greater detail below.

The relative tooth length of the spline gear 110 and the spline gear receiving grooves 116 are selected with respect to the width A of teeth 142, so that when the cam gear 98 is held in a fixed position, the cam 100 is also held in the same relative fixed position. When the transfer gear 96 is rotating above the lost motion land 140, the spring 120 provides an outwardly biasing force against the lever lower portion 136, to normally bias the lever in the dashed line position shown in FIGS. 4 and 6. It is apparent that other methods may be used to engage the cam gear 98 with cam 100. For instance, rather than the carriage actuated lever 130, a servo mechanism could be used to engage gear teeth 105, 142 with the transfer gear 96. For that matter, other mechanisms could be used to provide incremental rotation to the cam 100.

Figure 4:
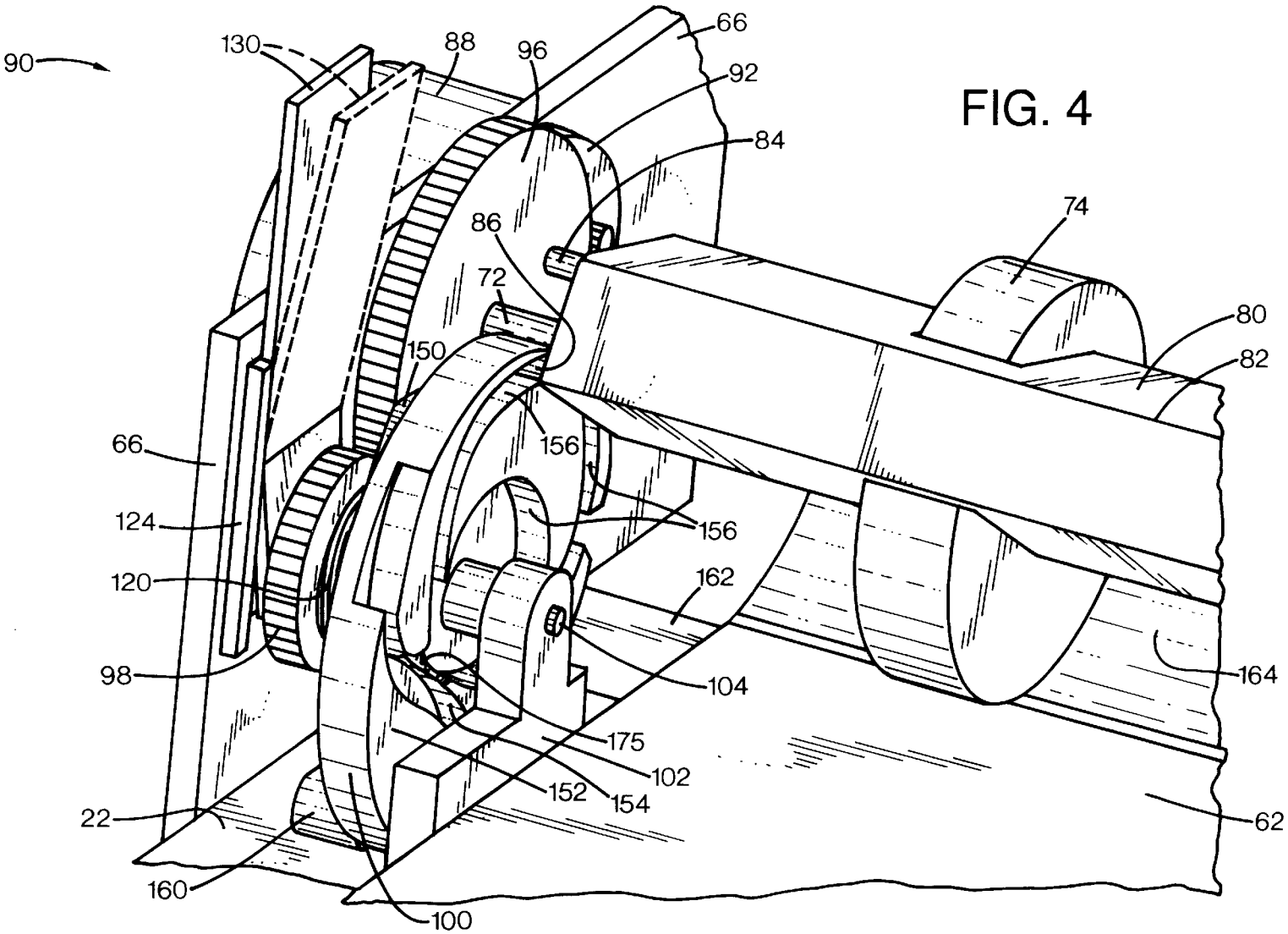
FIG. 4 is a fragmented, enlarged perspective view taken along line 4—4 of FIG. 2, showing the in-board side of one form of a media drive mechanism of the present invention

As shown in FIGS. 3 and 5, the dual sided adaptor cam 100 has an outboard surface 146. A land 148 extends from the outboard surface 146, with the land 148 having a periphery that defines a pick cam surface 150. As shown in FIGS. 2 and 4, the cam 100 also has an inboard land surface 152, which has a pick channel 154 and a pen-to-paper spacing ("PPS") channel 156 formed therein. In operation, the pick pin 84 on pivot 80 travels through the pick channel 154, whereas the PPS pin 86 travels through the PPS channel 156 during operation. Before discussing the operation of the adaptive media transport system 60, one additional facet remains to be discussed.

Referring to FIGS. 2 and 3, pivoted to chassis 22 by a pair of pivot pins, such as pin 158, is a plate lifter cam follower member 160, which activates a plate lifter member 162. The plate lifter member 162 extends along at least a portion of the underside of the pressure plate 62. The plate lifter 162 has a pair of pins, such as pin 161 (FIG. 2), which ride within slots, such as slot 163 formed within the lower surface of the pressure plate 62. Pivoting action of the lifter 162 raises and lowers the rear edge of the lifter plate t2. As mentioned earlier, the pressure plate 62 is biased upwardly by spring 65 (FIG. 2) into contact with the drive tires 74–76. Lifting the pressure plate 62 upwardly brings the media into contact with the pick tire 78 and drive tires 74–76, while lowering the pressure plate moves the media away from the tires 74–78. FIG. 4 shows an optional media guide 164, located adjacent the rear edge of the pressure plate 62. The media guide 164 is arcuate in nature to bend the media upwardly and around the exterior of the drive rollers 74–76 to assist in guiding print media around the periphery of the drive rollers. The media handling system may also include two or more pinch rollers, mounted on axles parallel to the drive axle 72, and having outer surfaces which may be elastomeric in nature to grip a sheet of media between the pinch rollers and the drive rollers 74–76. For the purposes of illustration, two typical pinch rollers 165, 166 are shown in their approximate locations in cross section in FIGS. 7–14. For clarity, the pinch rollers 165, 166 have been omitted from the views of FIGS. 2–6.

In operation, the adaptive transport system 60 not only feeds media from the input tray 28 to the output tray drying wings 30, but it also allows for adjustment of the pen-to-paper (PPS) spacing via a software routine which may be stored in the printer control 36, the host computer, or some combination thereof. Merely for the purposes of illustration, this software routine is described herein as occurring within the printer controller 36. First, the operation of the components of the transport system 60 will be described with respect to FIGS. 7–14, followed by a description of the software steps which control the action in FIGS. 15–19.

FIGS. 7–14 illustrate the interaction of the components of the adaptive media transport system 60. The views in FIGS. 7–14 show the outboard side 146 of the adaptor cam gear 100. FIGS. 7–14 show the interactions of the adaptor cam 100 with: (1) the pressure plate 62, via the plate lifter cam follower 160; and (2) the pivot 80, via the interaction of the pick and PPS pins 84, 86 with the pick and PPS cam tracks 154, 156, respectively. For clarity, the various drive gears 92–98, the shift lever 130, the chassis 22, chassis wall 66, and motor 88 are omitted from FIGS. 7–14.

Figure 7:
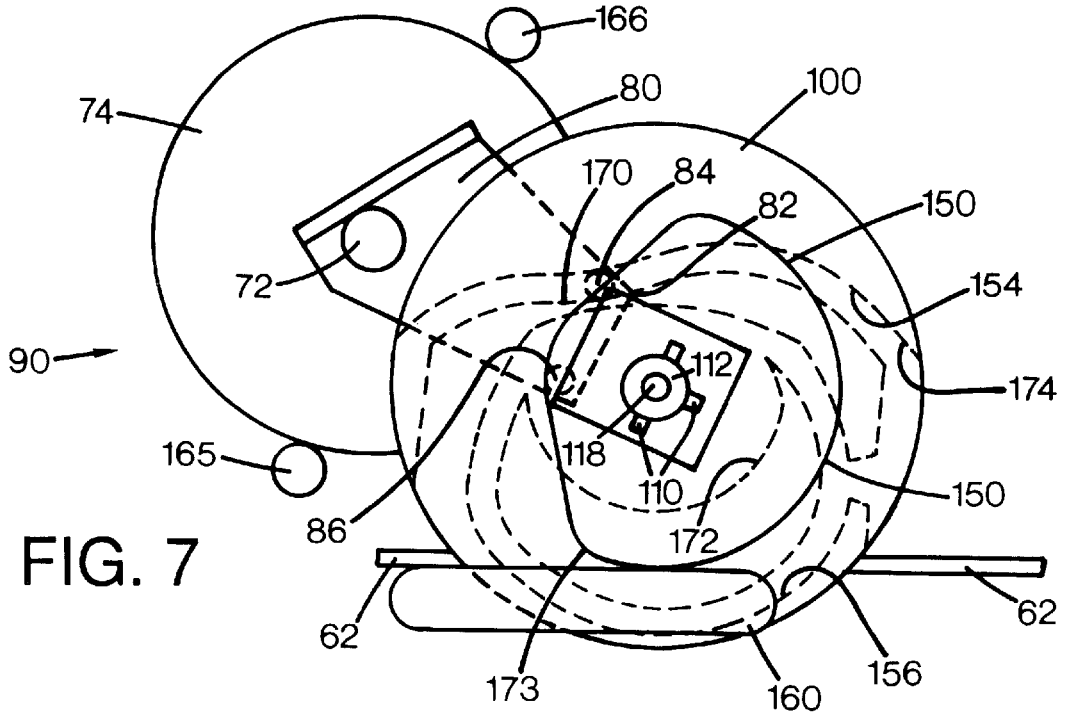
FIGS. 7–14 are out-board side elevational views, taken generally along line 7—7 of FIG. 6, but with the shift lever, drive motor and several of the drive gears removed for clarity, and more specifically.

FIG. 7 shows the initial position of the drive mechanism 90. This position may be referred to as a rest or start position, and it is also the position from which media may be ejected or kicked from the drive mechanism to be totally supported by wings 30, prior to being dropped into the output tray 32. To begin the media pick cycle, the drive system begins a transition, shown in FIG. 8, as motor 88 and the drive mechanism 90 rotates cam 100 counterclockwise in the views, as shown by arrow 168. Before beginning the pick cycle, at rest in FIG. 7 the pick pin 84 is approximately midway along the pick track 154, resting in a slightly dipped portion 170 of the track. The PPS pin 86 is located in a central open region 172 of the PPS track 156. In these positions, the pins 84, 86 have drawn the pivot leading edge 82 downwardly, which assists in ejecting media from the drive mechanism. In FIG. 7, the pick pressure plate cam 150 is shown holding cam follower 160 and the lifter plate 62 in lowered positions, which leaves the spring 65 (FIG. 2) in a compressed state.

Figure 8:
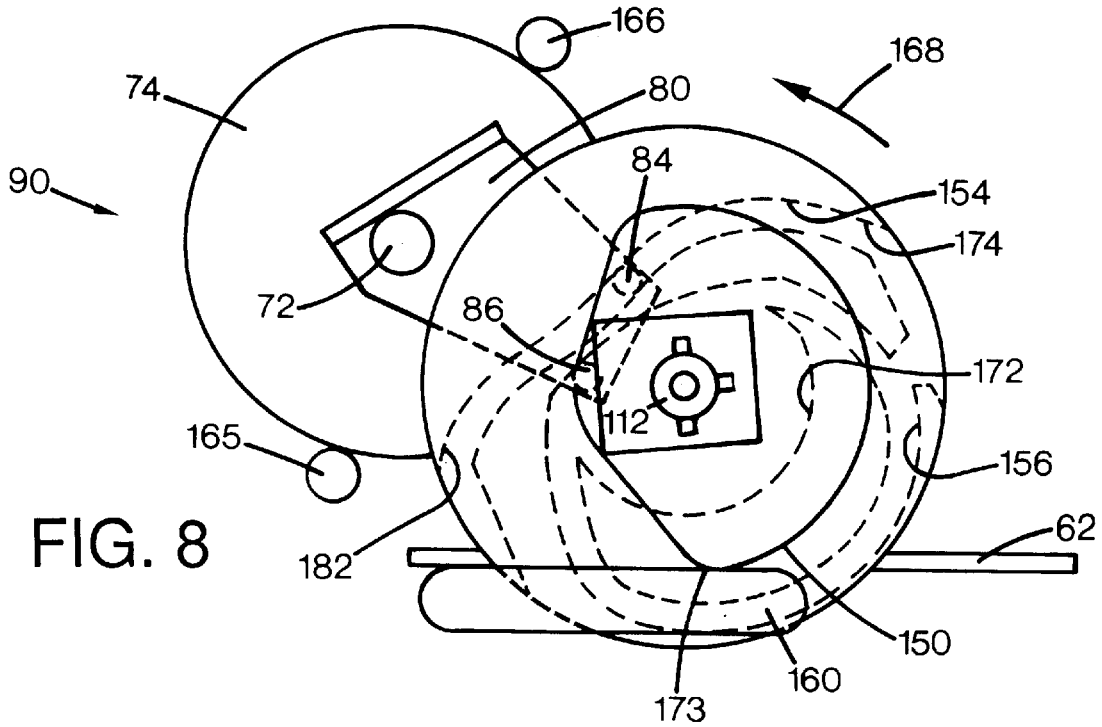

FIG. 8 shows the drive system in transition from rest (FIG. 7) to begin the media pick cycle as motor 88 and the drive gears 92–98 rotate the adaptor cam 100 counterclockwise, as shown by arrow 168. In this transition stage, a raising nose portion 173 the pressure plate cam 150 is at the final position where it holds the plate lifter cam follower 160 in a lowered position. The PPS pin 86 is adjacent the wall of the PPS cam track 156, while the pick pin 84 is transitioning through cam track 154 toward an exit end 174, but the relative position of the pivot 80 has not yet changed from the rest position of FIG. 7.

Figure 9:
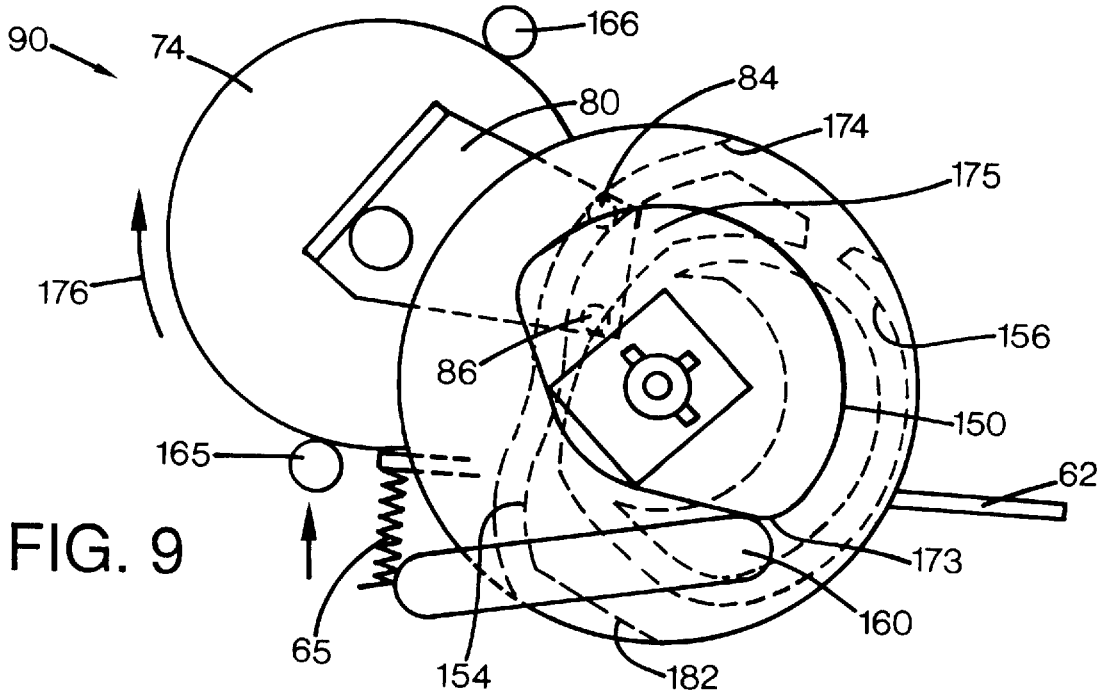

FIG. 9 shows the beginning of the media pick operation, where the pressure plate cam follower 160 is no longer held in a lowered position by the pressure plate cam 150. This allows the pressure plate spring 65 to push the pressure plate 62 upwardly, into a maximum position where it is engaged with the drive rollers 74–76. The pick pin 84 continues to travel through the pick track 154 toward the exit end 174, but the PPS pin 86 has left track 156. The PPS pin 86 is advantageously constructed to be shorter than the pick pin 84, which allows the PPS pin 86 to actually travel over a recessed portion 175 of the land surface 152, located between tracks 154 and 156. As the pressure plate 62 raises, the upper sheet of media resting thereon is drawn into the media feed path, preferably using the softer durometer pick tire 78, assisted by the drive tires 74, 76, when rotated in the direction indicated by arrow 176.

Figure 10:
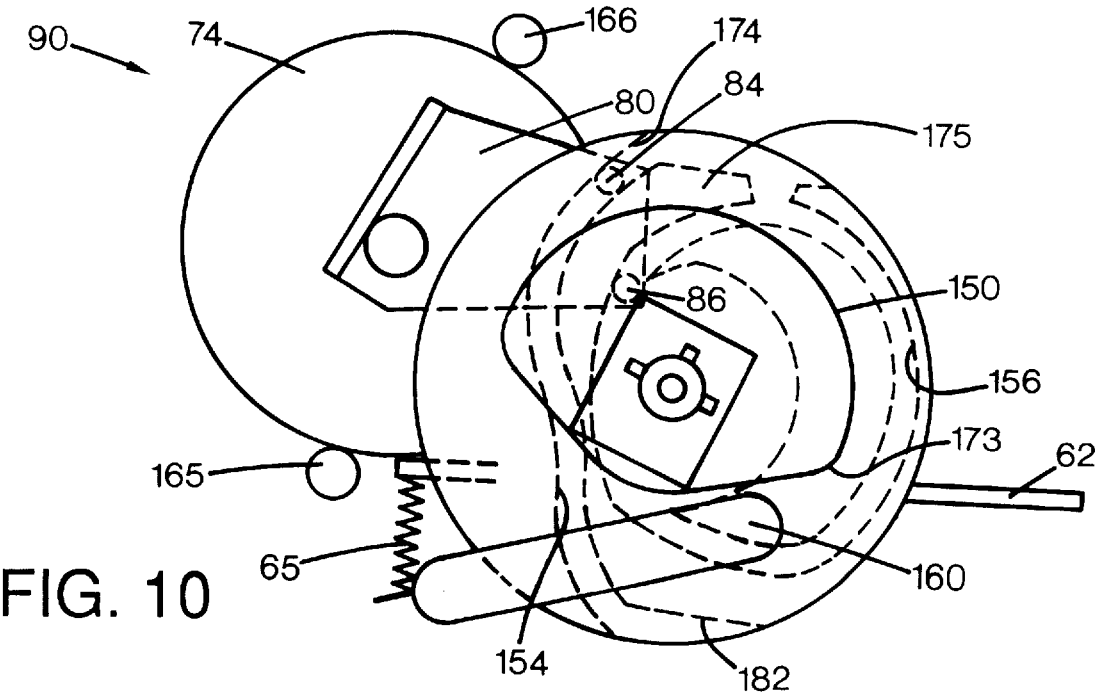

FIG. 10 shows a further continuation of the pick operation, where the pressure plate cam follower 160 is no longer held in a lowered position by the cam surface 150. Indeed, while the cam surface 150 may be configured for continuous contact with follower 160, the preferred design allows for different media thicknesses to be accommodated by the degree of compression of the pressure plate spring 65. That is, the spring may be allowed to compress to different degrees to accommodate different thicknesses of media, such that the upward travel is not limited by the contact of the cam follower 160 with cam 150. During this continuing of the pick operation, the PPS pin 86 is now back in contact with the PPS track 156 after traversing the recessed land 175, while the pick pin 84 is now closer to the exit 174 of track 154.

Figure 11:
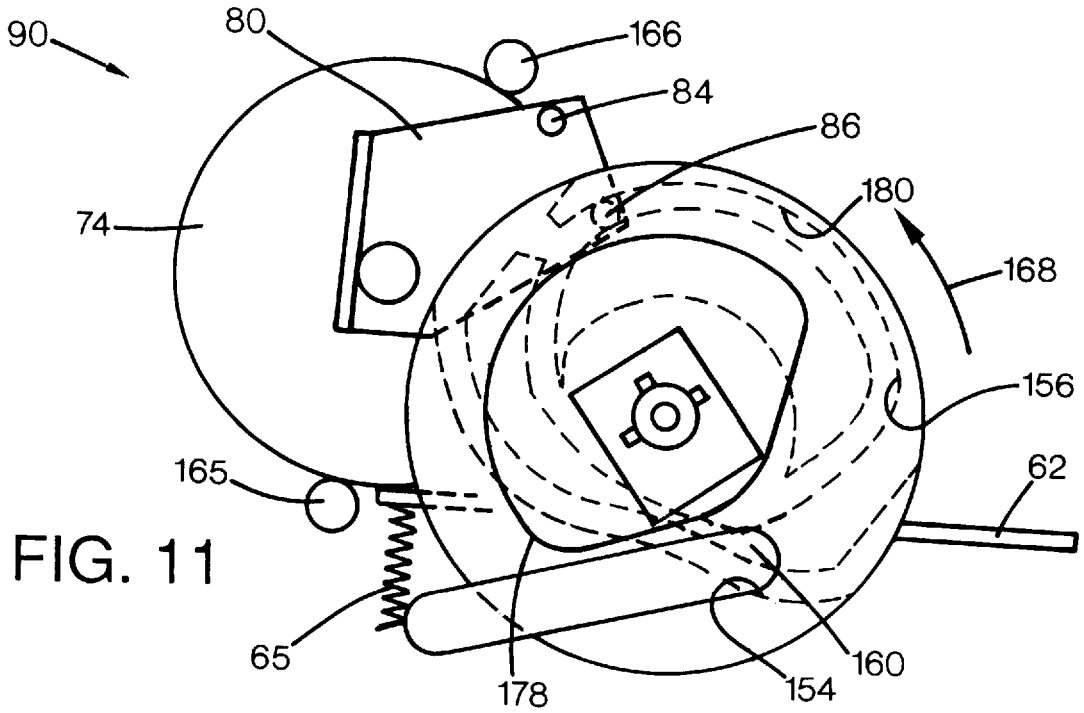

Upon completion of a successful pick routine, FIG. 11 shows the beginning of a transition, where the pressure plate 62 is lowered. In FIG. 11, the further rotation of cam 100 in the direction of arrow 168 causes a lowering nose portion 178 of the cam 150 to force the follower 160 down. Downward motion of follower 160 allows the plate lifter member 162 to pull the pressure plate 62 downward into a print position. The pivot 80 has now been raised to a more upright, near-print position in FIG. 11. The pick pin 84 has now exited the pick track 150, and the PPS pin 84 has begun to enter a PPS adjust portion 180 of track 156. In transitioning from FIG. 11 to FIG. 12, it can be seen that the pressure plate 62 is lowered, which compresses spring 65 as the pressure plate cam 150 holds the follower 160 in a lowered position.

Figure 12:
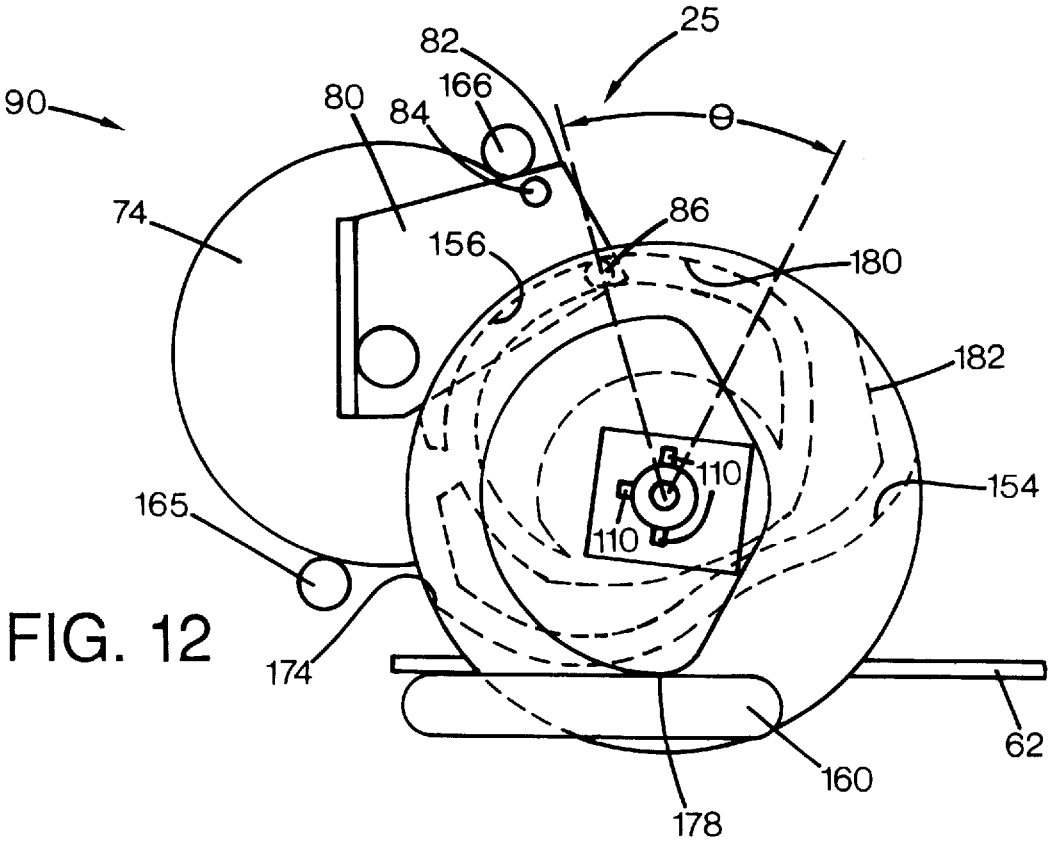

FIG. 12 shows the end of the media pick routine, and the beginning position of the PPS adjust routine. Briefly referring back to FIG. 5, it can be seen that the cam drive gear grooves 116, which receive the splines 110 of cam 100, are in a position of approximate engagement when located as shown in FIGS. 5 and 12. As noted before, in this region of travel, the cam spring 120 pushes the cam gear 98 toward the outboard side of the chassis 22, and away from cam 100. This action allows the teeth of the transfer gear 96 to ride within the lost motion region 140 of the cam gear teeth 105. In this manner, the cam 100 is disengaged from being driven while the motor 88 continues to turn the drive tires 74–76 and incrementally advance media through the printzone 25. Thus, the pivot 80 is decoupled from the media drive function so the pivot leading edge 82 is held in a position to accurately support media at a desired pen-to-paper spacing away from the printheads 54, 56 during printing.

Figure 13:
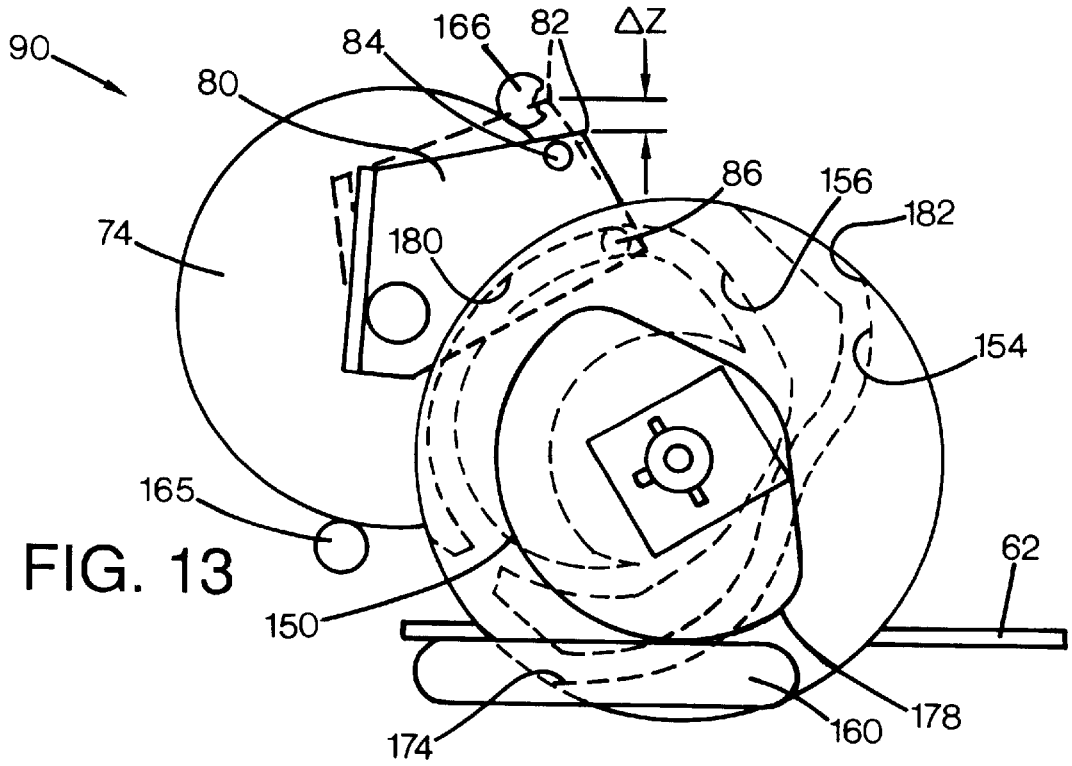

FIGS. 12 and 13 illustrate the PPS adjustment routine, with FIG. 12 showing the beginning of the routine, where the pen-to-paper spacing is at a minimum, while FIG. 13 shows the maximum PPS adjust position. To engage the cam gear 98 with the cam 100 during the PPS adjust routine, the printhead carriage 40 travels to the far left of the printer 20, to engage the shift lever 130 (see FIG. 6). The lower portion of the shift lever 130 forces the PPS adjust teeth 142 of cam gear 98 into engagement with the transfer gear 96. The drive motor 88 then rotates a selected number of steps to advance the cam gear to position corresponding to a selected PPS spacing, either at the minimum position of FIG. 12, the maximum position of FIG. 13, or any other location therebetween in track 180.

In rotating from the minimum position of FIG. 12, through the PPS adjustment portion 180 of track 156, the cam 100 rotates through a total angle $\theta$, shown in FIG. 12. In rotating from the minimum to the maximum position, the pivot leading edge 82 can be seen to have been lowered, by a distance of $\Delta Z$ shown in FIG. 13, where the minimum PPS adjust position of the pivot from FIG. 12 is shown in dashed lines. Upon reaching the desired location for the PPS pin 86 within the PPS adjustment track 180, the printhead carriage 40 then moves away from the shift lever 130. Without pressure from the lever 130, the spring 120 pushes cam gear 98 toward the outboard side of the printer 20, so teeth 142 are no longer engaged with the teeth of the transfer gear 96, and instead, rotate within the cam gear lost motion portion 140. Thus, at the proper PPS adjustment, with the adaptor cam 100 decoupled from motor 88, the pivot 80 is held at a fixed elevation, and printing may commence. It is apparent that during operation, if the type of media should change or some adjustment in print quality be desired, that the carriage 40 can engage the shift lever 130, and the PPS spacing may be adjusted by further cam rotation, either counterclockwise or clockwise, to locate pin 86 in a different portion of the PPS adjust track 180. The usefulness of the PPS adjustment capability is discussed further below, with respect to the software system illustrated in FIGS. 15–19.

Figure 14:
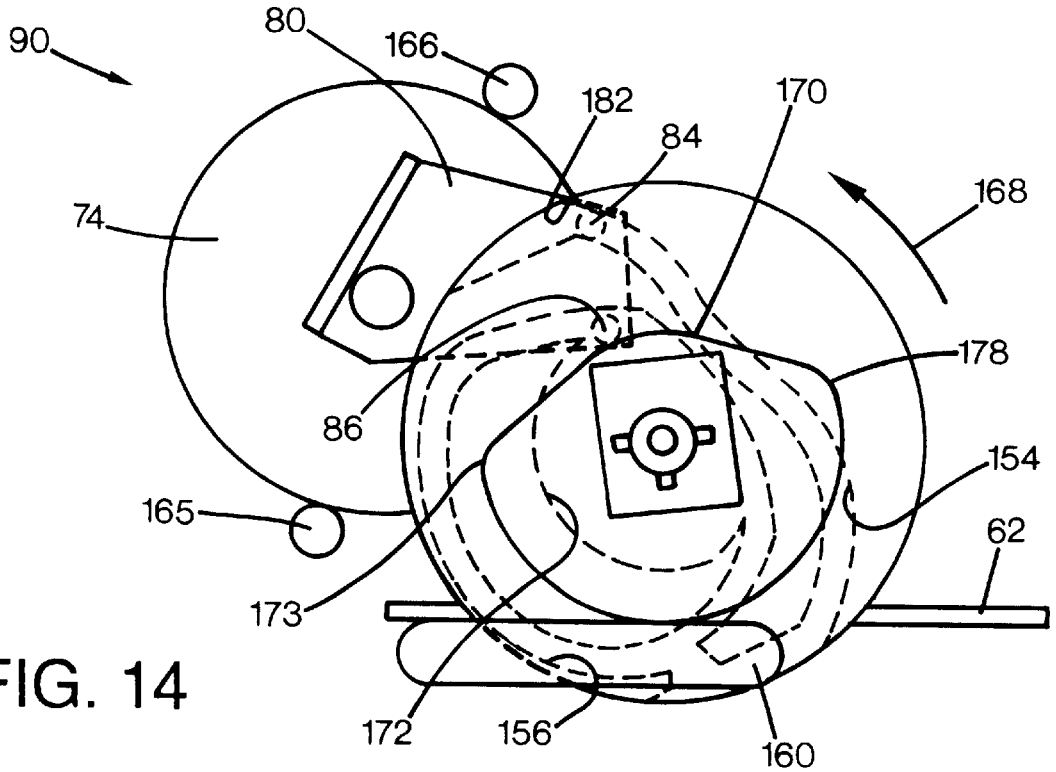

Upon completion of printing, FIG. 14 shows a transition from the PPS adjust and print position (FIGS. 12 and 13) to the start position shown in FIG. 7. During this FIG. 14 transition, the pick pin 84 enters an entrance portion 182 of the pick track 154. The PPS pin 86 now enters the free region 172 of the PPS track 156. In making this transition, the pivot leading edge 82 begins to lower, to the rest position shown in FIG. 7. During this transition, the pressure plate 62 is held in a lowered position by engagement of cam follower 160 with the pressure plate cam 150.

To initiate the transition of FIG. 14, the printhead carriage 140 engages the shift lever 130, compressing spring 120 (FIG. 6), which engages the narrow cam gear teeth 142 with the transfer gear 96. Rotation of the cam gear past the band of narrow teeth 142 allows the full width of the cam gear teeth 105 to engage the transfer gear 96. The frictional forces of this full tooth width engagement overcomes the axial force of spring 120, so the gears 96 and 98 remain engaged even when the shift lever pressure is removed. Thus, when rotated past the lost motion region 140 and teeth 142, the carriage 40 is free to return the pens 50, 52 to the service station for servicing. Continued rotation of cam 100 discharges the printed media onto the drying wings 30, and brings the drive mechanism back to the rest position of FIG. 7. When at rest, the cam gear 98 is held in a fixed position through engagement with the transfer gear 96. As the pivot 80 pivots downwardly to the rest position of FIG. 7, the output tray wings 30 advantageously raise upwardly into a retracted position for storage, as shown by arrows 184 in FIG. 1. The operation of the wings 30 may occur in conjunction with, or independently from, the operation of the adaptive media transport system 60 illustrated herein.

Method of Operation

FIGS. 15–19 are flow charts showing the various steps of engagement illustrated in FIGS. 7–14. To accommodate for manufacturing tolerance accumulations of the various parts used to construct the media transport system 60, the initial adjustment of the PPS spacing may occur at the factory, as illustrated 60, the factory PPS tolerance adjust flow chart 200 in FIG. 15. For instance, for a particular printer assume that the optimal adjust is determined to occur at an angle of 10° for θ (FIG. 12). This 10° rotation value may be easily translated in to a particular number of steps which motor 88 turns. This particular step value corresponding to θ=10° then may be permanently stored in a read only memory (ROM) portion of the printer controller 36 and recalled for a nominal adjustment prior to printing.

Figure 15:
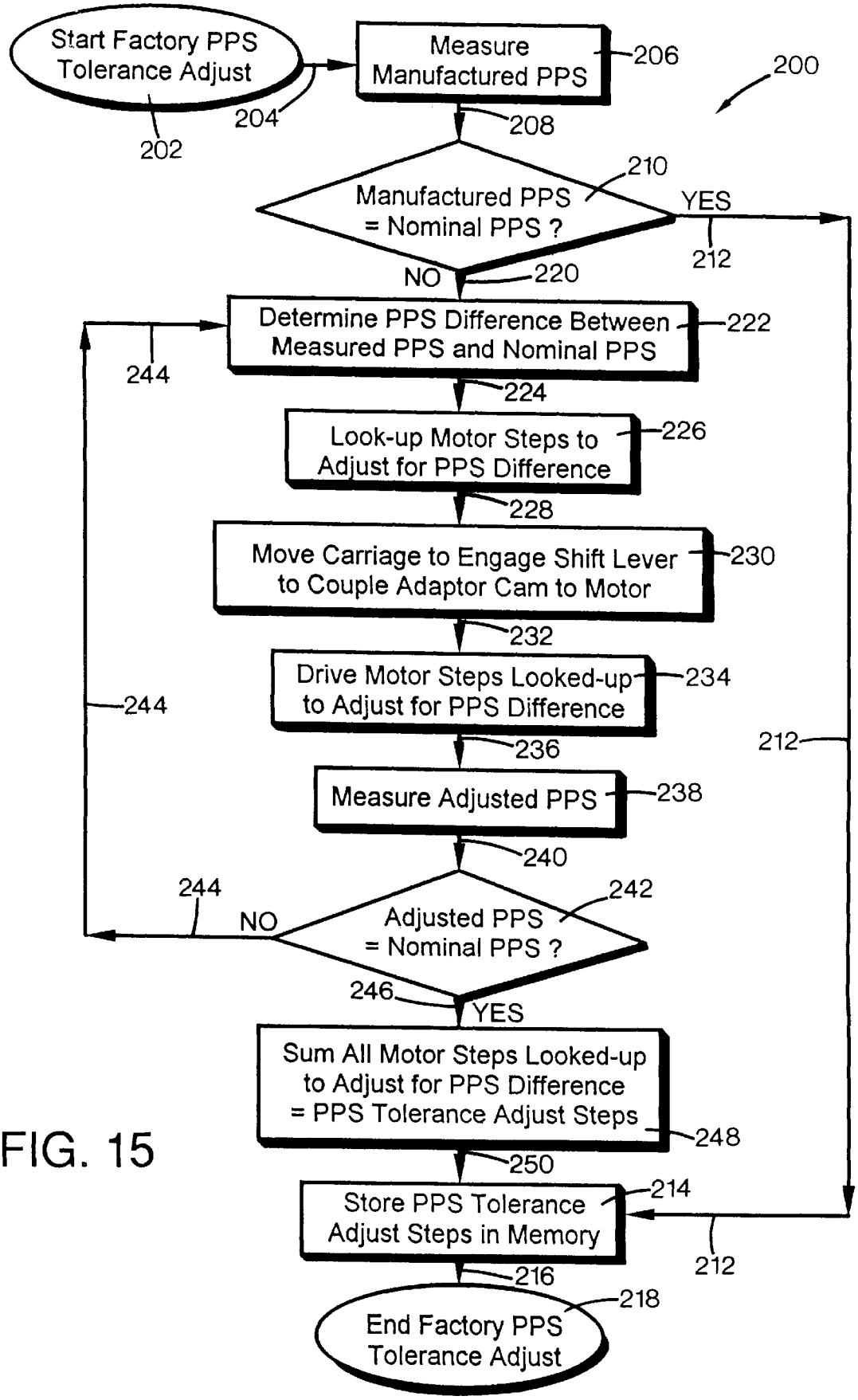
FIG. 15 is a flow chart illustrating one manner of adjusting the adaptive media handling system of FIG. 1 during initial assembly of the printing mechanism at the manufacturing facility.

The process of FIG. 15 starts at an operator initiated step 202, which generates a start command 202. In response to the start command, the actual pen-to-paper spacing is measured in a measure manufactured PPS step 206 using gauges or optical means, for example, and a signal 208 corresponding to measured manufactured PPS is supplied to a comparator portion 210. The comparator 210 compares the magnitude of the measured manufactured PPS signal 208 with a nominal PPS value, and if they match, emits a YES signal 212. The YES signal 212 indicates a perfect nominally toleranced system 60 requiring zero factory adjustment. This YES signal 212 is sent to a factory PPS tolerance storage routine 214 where the PPS tolerance adjust steps are stored in memory, such as in a ROM (read only memory) portion of the printer controller 36. The YES signal 212 corresponds to a PPS tolerance adjust steps of zero, since the printer is at the nominal design PPS spacing. Following the storage step 214, a completion signal 216 is emitted and an end factory PPS tolerance adjust step 218 is performed, perhaps by giving an assembly worker a visual signal, or by automatically allowing the printer to proceed down the assembly line.

A more likely scenario is that the comparator 210 finds that the magnitude of the measured manufactured PPS signal 208 does not match a nominal PPS value, so a NO signal 220 is transmitted to step 222. In step 222, the PPS difference between the measured PPS and nominal PPS values is determined, and a difference signal 224 is supplied to a look-up routine 226. The routine 226 looks-up the number of motor steps encoder counts, or encoder positions required to adjust for the PPS difference, then emits a signal 228 to a move carriage step 230. The look-up routine 226 also stores this retrieved value for later recall until a new printer is tested.

Having determined the number of motor steps required to adjust the PPS pin 86 to a location in the adjustment portion 180 of track 156, the system will now verify that this adjustment will indeed bring the PPS spacing ΔZ (FIG. 13) to the nominal value. In response to signal 228, in step 230 the printer controller 36 moves the carriage 40 in a conventional manner to engage the shift lever 130, which couples the adaptor cam 100 to motor 88. When the controller 36 receives conventional positional feed back that the carriage has engaged lever 130, the controller then issues a drive motor signal 232. The extent to which motor 88 rotates is controlled by step 234 to be the number of steps looked-up in step 226 to locate the pivot leading edge 82 at what is thought to be the nominal PPS spacing. At the conclusion of this repositioning, a signal 236 is supplied to another measurement step 238, where the adjusted PPS is measured, and a measured adjusted PPS signal 240 is generated.

Once again, the magnitude of the adjusted PPS signal 240 is compared to the nominal PPS value by a second comparator 242. If the adjustment was unsuccessful, a NO signal 244 is supplied back to the determine difference step 222. The steps 222 through 242 may be repeated as necessary until the adjustment to the nominal PPS is successful and a YES signal 246 is generated. During any successive iterations of steps 222 through 242, the values retrieved in step 226 are all stored. In response to receiving the YES signal 246, step 248 sums together the values stored at step 226 to arrive at a total number of PPS tolerance adjust steps, represented by signal 250. The summation of these tolerance adjust steps is stored in a memory portion of the controller 36 in step 214 as described above, and the factory adjust routine terminates at step 218.

It is apparent that the majority of the factory adjust process 200 may be automated at the factory, rather that requiring extensive operator involvement, manual adjustments, tightening of set screws to hold the adjustment, etc. This is especially true if the measurement device is some type of transducer, such as an optic device that generates the measurement signals 208 and 240 and provides them as input signals to the printer controller 36. In this manner, a smart self-testing printer 20 is provided. Alternatively, the process in flow chart 200 may be performed in part by an auxiliary computer or other processor communicating with the printer controller 36. This system may also be advantageously used by personnel servicing a printer. In either implementation, human error is virtually eliminated from the process. The tolerance adjust value is stored in ROM in the printer controller, where it is accessed prior to each printing job (described further below). Thus, the printer cannot be jostled out of a mechanical adjustment during shipping.

Figure 16:
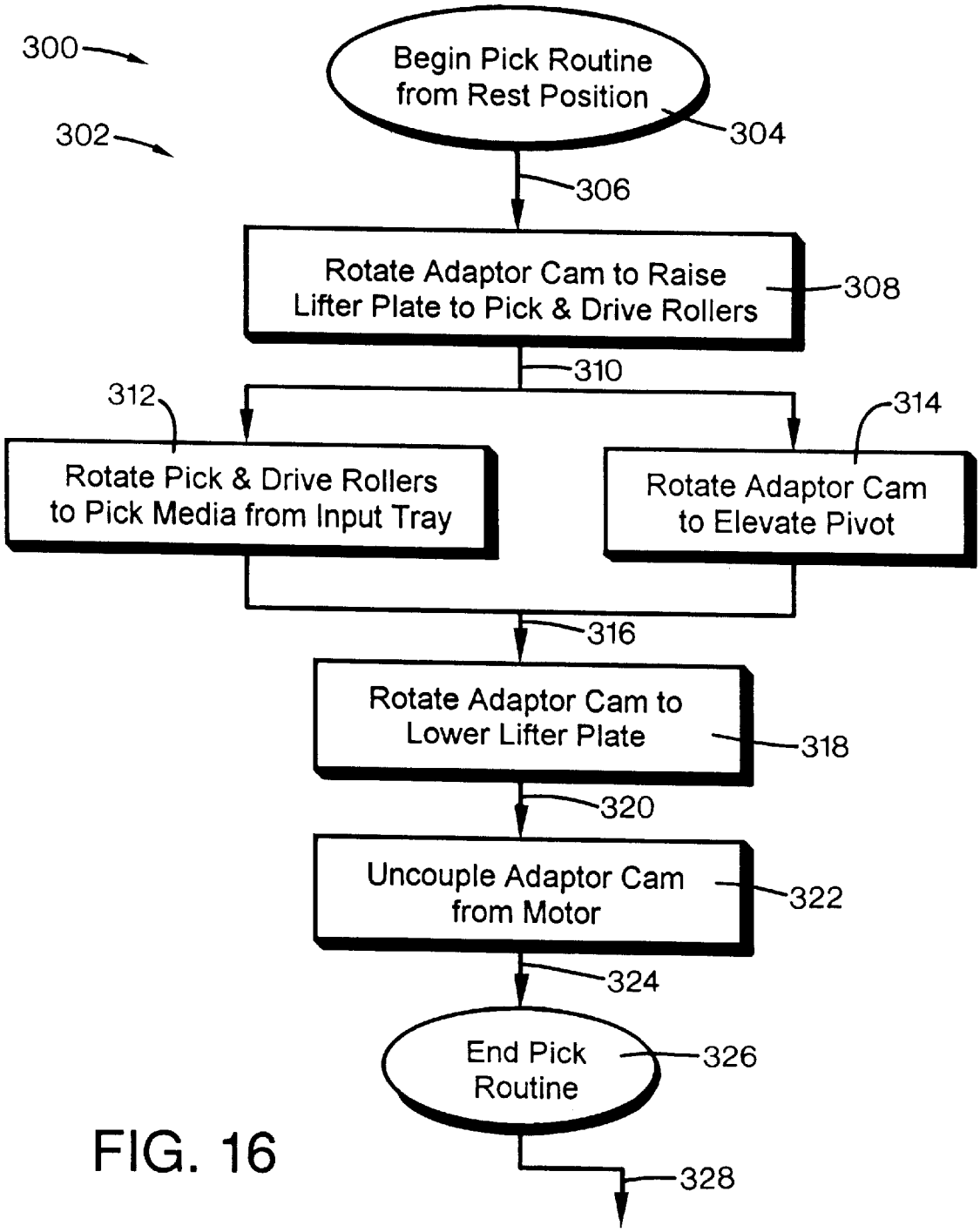
FIGS. 16–19 are portions of a flow chart illustrating one manner of operating the adaptive media handling system of FIG. 1, including a media pick routine (FIG. 16), a PPS adjust routine (FIG. 17), a printing routine and media discharge routine (FIGS. 18 and 19).

Moving from the manufacturing context, flow chart 300 in FIGS. 16–19 shows a printing operation having several routines comprising several steps each, such as the pick routine 302 in FIG. 16. The pick begins with step 304, where the controller 36 issues a start pick signal 306 indicating that a sheet is to be printed. In response to the start pick signal 306, from the rest position of FIG. 7, in step 308 the motor 88 rotates the adaptor cam 100 to raise the lifter plate 62 to touch the drive and pick rollers 74–78, as shown in transitioning through FIG. 8 to the FIG. 9 position. Upon accomplishing step 308, the controller 36 generates a continue rotation signal 310 which continues rotation of the drive and pick rollers 74–48 to pick media from the input tray 28 in step 312, while simultaneously raising the media support pivot 80 in step 314. The operation of steps 312 and 314 is shown by the transition of the drive mechanism 90 from FIG. 9 through FIGS. 10 and 11, after which signal 316 is then generated.

Upon receiving signal 316, rotation of the adaptor cam 100 continues in step 318 to lower the lifter plate 62 to the end feed position of FIG. 12. Upon reaching the FIG. 12 position, signal 320 is generated by controller 36 and rotation of the cam 100 is stopped. In this position, the transfer gear 96 engages only the narrow teeth 142, and spring 120 pushes the cam gear 98 out of engagement with the transfer gear, uncoupling the cam 100 form the motor 88 in step 322. At this point signal 324 is generated to indicate that the pick routine 302 has concluded at step 326, and an end pick signal 328 is generated.

Figure 17:
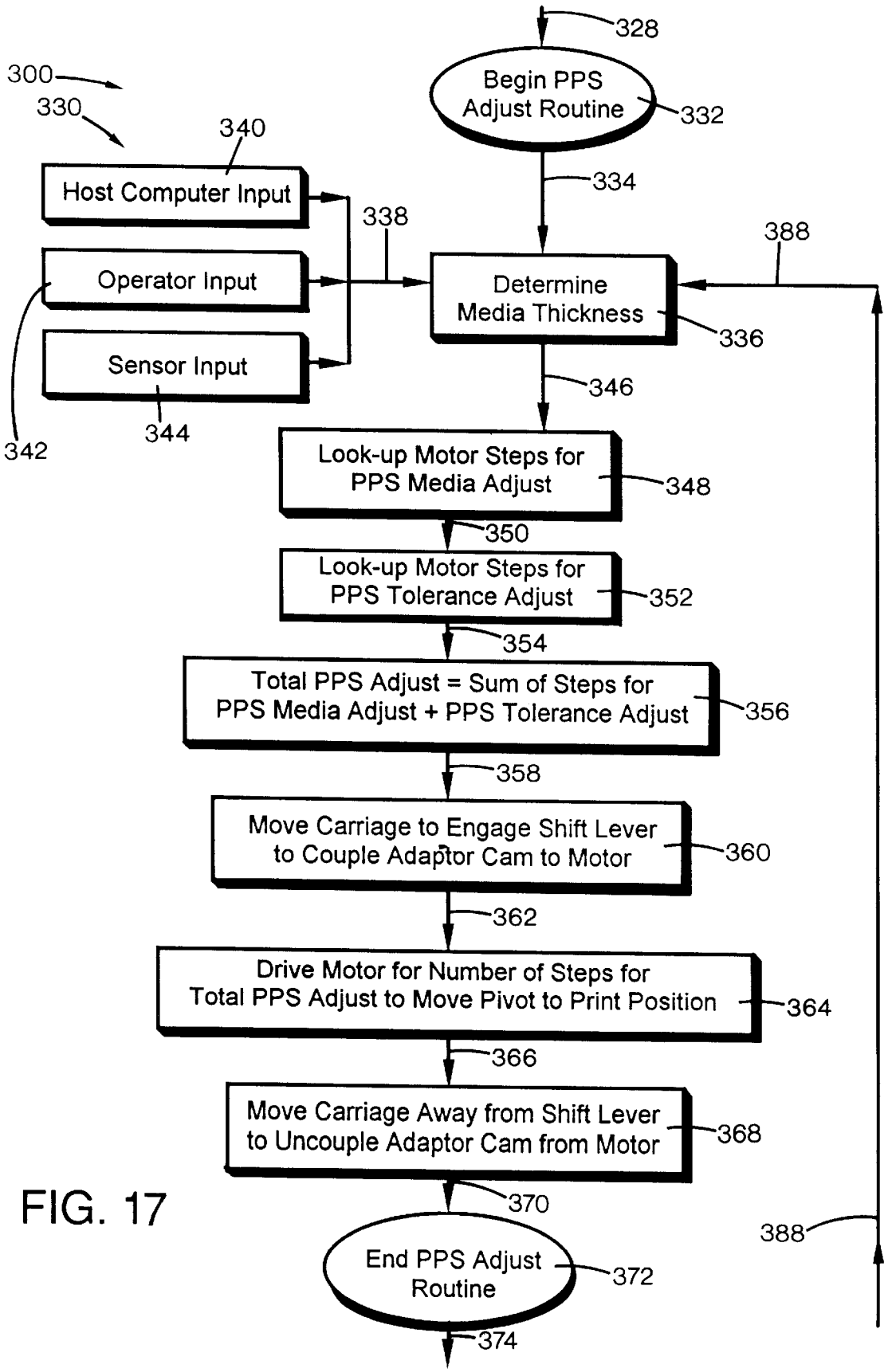

In FIG. 17, a PPS adjust routine 330 of the process 300 is shown receiving the end pick signal 328. In response to signal 328, a begin PPS adjust routine step 332 generates a start signal 334, which is received by a determine media thickness step 336. The determine thickness step 336 also receives another input signal 338, which may be generated by one or a combination of a host computer 340, an operator activated input mechanism 342, and a sensor input 344. The input signal 338 carries information as to what the media thickness may be. The manner in which the printer controller 36 determines that an envelope is being feed to the printer rather than plain paper or other media, may be accomplished in a variety of ways. For example, it could be input by the user from a keypad on the printer exterior, or through user input from the host computer 340. The host computer 340 may automatically generate signal 338 based upon the type of document being printed, without further user input. Alternatively, a media thickness sensor 344 could be installed adjacent to chassis wall 68, for example, to sense the thickness of an upcoming sheet of media.

Once step 336 determines the media thickness, signal 346 is supplied to a look-up step 348. Step 348 correlates the media thickness from the information in signal 346 with the number of motor steps required to for an ideal PPS media adjustment, and generates a media adjust signal 350. Upon receiving the media adjust signal 350, or simultaneously with the looking-up in step 348, step 352 looks-up the motor steps for PPS tolerance adjust stored at the factory in the controller memory in step 214 of FIG. 15. A PPS tolerance adjust signal 354 is supplied to a totaling step 356, and the media adjust signal 350 is also delivered to the step 356, shown here as passing through block 352. In step 356, a total PPS adjust signal 358 is generated by sum the number of motor steps required for the PPS media adjust from step 348 and the PPS tolerance adjust from step 214 (FIG. 15). For instance, an envelope or other thick media may, take an additional 10° of rotation for angle θ to increase the ΔZ PPS spacing. When the controller 36 is made aware that an envelope is being printed, the controller can direct motor 88 to step not only the initial 10° required to accommodate the particular printer tolerances, but an additional 10° to increase the PPS spacing to accommodate the envelope.

Upon determining the number of motor steps required to adjust the PPS, in step 360 the controller then moves the carriage 40 to engage shift lever 130 to couple the adaptor cam 100 to motor 88, as described above with respect to step 230 of FIG. 15, and upon completion signal 362 is generated. In response to receiving signal 362, step 364 drives the motor 88 for number of steps for total PPS adjust of signal 358 to move the pivot 80 to the selected PPS print position, somewhere at or between the minimum position of FIG. 12 and the maximum position of FIG. 13. When in the selected PPS print position, a signal 366 is generated to indicate that step 368 may now let the controller 36 move the carriage 40 away from the shift lever 130 to uncouple the adaptor cam 100 from motor 88, as described for step 332 of FIG. 16. Upon completion of step 368, a signal 370 is supplied to an end PPS adjust routine step 372 which then generates an end PPS adjust routine signal 374.

Figure 18:
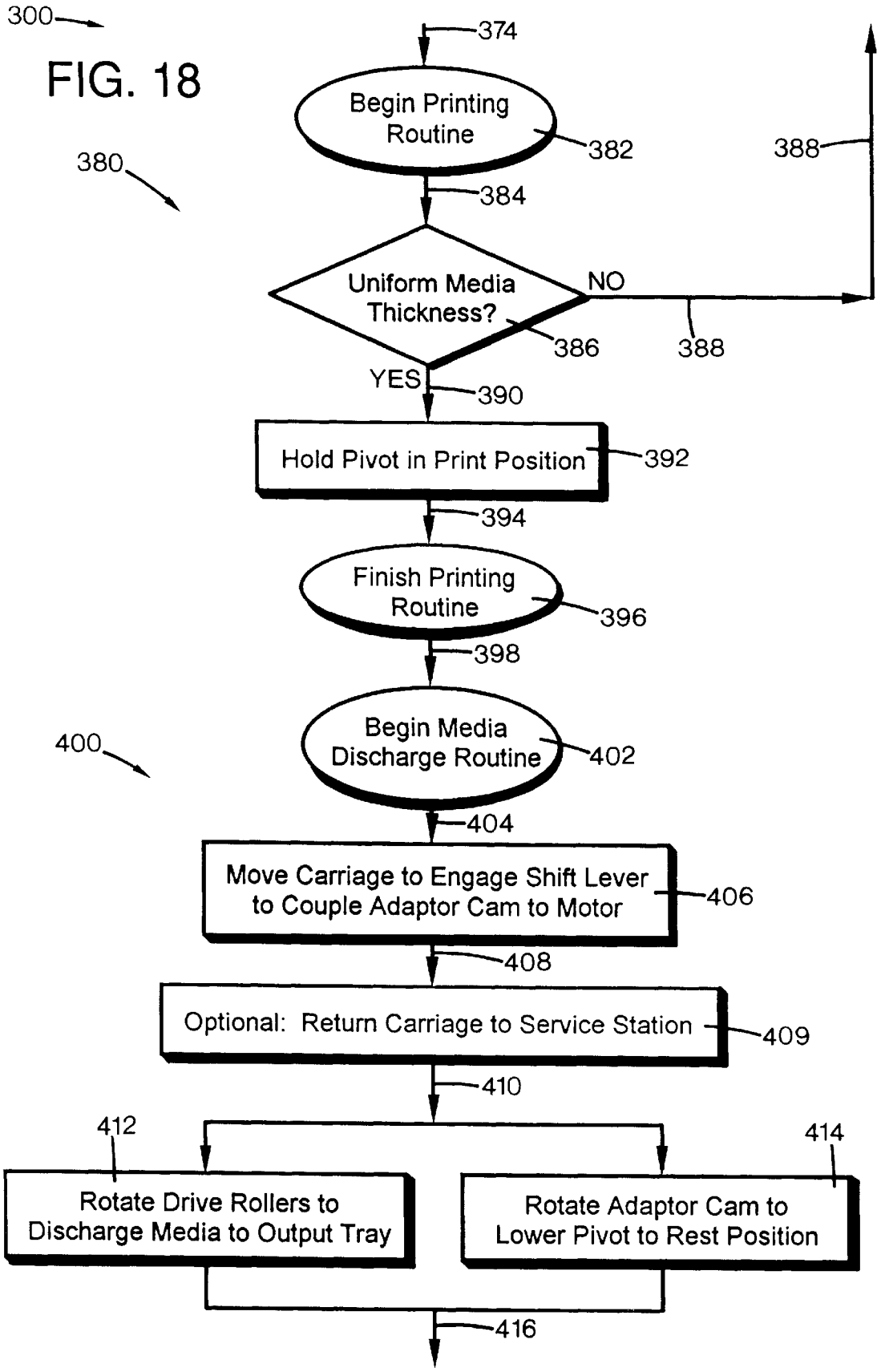

In FIG. 18, a print routine 380 of the process 300 is shown receiving the end PPS adjust routine signal 374. In response to signal 374, a begin printing routine step 382 generates a start signal 384, which is received by a uniform media thickness query step 386. The uniform media thickness query step 386 looks for changes in the media thickness or effective thickness due to ink saturation causing cockle (described in the Background portion above), and when found, supplies a NO signal 338 to the determine thickness step 336 of FIG. 17 where further adjustments are made by the PPS adjust routine 330.

Thus, the PPS adjustment may be made during printing to accommodate different media thicknesses. Note, this PPS adjust not only need occur at the beginning of printing a sheet, but may also occur during the printing of the sheet. For example, a new type of paper has recently become available upon which to print banners, for instance, one that would say "Happy Birthday" and would be displayed on a wall. This banner paper is supplied in Z-fold stack, for instance of letter sized paper, joined by perforated portions along the top and bottom edges. The earlier printers were vulnerable to damage when using banner-type paper. Since the perforations usually have paper fibers extending therefrom, there is the increased damage that paper fibers could be jammed into the nozzles, causing permanent damage. Moreover, even if the nozzles are not damaged, contact of the perforations with the nozzle plate could smear ink on the pen face, dirtying the printhead and damaging the image in the region of the perforation. This adaptive system 60 of printing on perforated paper avoids the risk of the upwardly projecting tents at a perforation hitting the orifice plates of printheads 54, 56 during printing.

When feeding through the printer 20, the major portion of the perforated paper is the thickness of plain paper. However, as the perforation approaches the print zone there is an increase in the apparent thickness of the media, due to the perforation raising up toward the printheads 54, 56. Thus, as a perforation is approached (the approach of which may be determined by counting the number of steps motor 88 has advanced since printing of the banner began) carriage 40 could engage lever 30 and cam 100 could be advanced to increase the PPS spacing ΔZ in the region of the perforation. Then following printing at the perforation, the PPS spacing could be readjusted back to the nominal position as the carriage again engages lever 130.

Besides adjusting the pen-to-paper spacing for the type of media, the controller 36 may also adjust the pen-to-paper spacing based on the type of image being printed. For example, an image having a large amount of ink, such as a photographic type image or graphics, may saturate the media during printing, causing the media fibers to expand, causing media cockle. Thus, for these heavily saturated images, the controller 36 may interpret the incoming data stream from the host computer as being a saturated image, and increase the pen-to-paper spacing as described above with respect to FIGS. 12 and 13. Also from the host computer 340, the user may make a selection that a postcard, rather than an envelope, is being printed. In this case, the pen-to-paper spacing may be adjusted for a postcard thickness, rather than an envelope thickness, allowing the postcards to be printed at a much closer pen-to-paper spacing gap, resulting in a higher quality image on the postcard. A smaller pen-to-paper spacing is believed to increase print quality, because there is less distance for the ink droplets to travel, and a lesser chance of over-spray occurring which would blur the image. Indeed, in a humid environment, it may be desirable to increase the pen-to-paper spacing to account for humidity absorbed by normal media, which may cause it to thicken somewhat, requiring a larger gap.

Returning to FIG. 18, when the media thickness is uniform, step 386 generates a YES signal 390, which is transmitted to a hold pivot position step 392 until printing of the sheet is complete, indicated by signal 394. Upon receiving the printing complete signal 394, a finish printing routine step 396 concludes the routine 380 by issuing a finished printing signal 398. After printing is complete, a discharge media routine 400 portion of the overall process 300 initiates media discharge from the media transport system 60. In response to the finished printing signal 398, a begin media discharge step 402 generates a start signal 404, which in turn causes the carriage 40 to engage the shift lever 130 to couple the adaptor cam 100 to motor 88 in step 406, in the same manner as described above for the steps 230 and 360. After sufficient movement has occurred to mesh the full width of the cam gear teeth 105 with the transfer gear 96, indicated by signal 408, the carriage 40 may be returned to the service station 45 in step 409.

Figure 19:
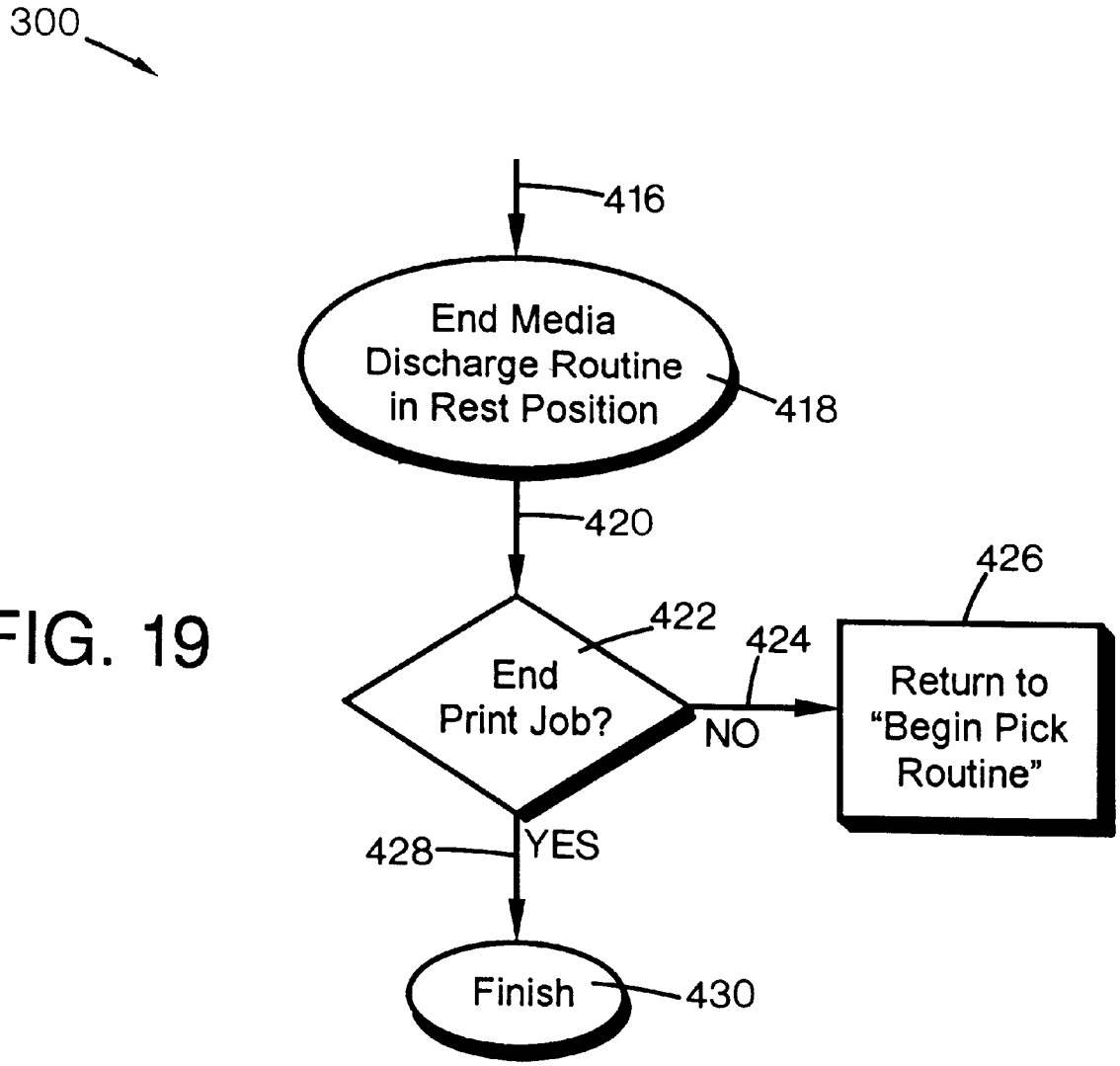

Upon completion of step 406 and step 409, if this optional step is performed, a signal 410 indicates that rotation of the drive tires 74–76 may continue in step 412, and that cam 100 should continue to rotate to lower the pivot 80 to the rest position in step 414. The illustrated simultaneous occurrence of step 412 and 414 is shown by the transition of the drive mechanism 90 from the printing position of FIGS. 12 and 13, through the view of FIG. 14, and to conclude with the mechanism 90 in the rest position of FIG. 7, at which point signal 416 is generated. As shown in FIG. 19, in response to signal 416, an end media discharge step 418 issues a media discharge complete signal 420.

After printing and discharging the printed sheet, it may be helpful to determine whether there are additional sheets to be printed. In FIG. 19, in response to signal 420 this question is asked in an end print job query step 422. If additional sheets remain to be printed, a NO signal 424 is issued to a return to the begin pick routine step 426, which starts again at step 304 of FIG. 16. If the print job is complete, then step 422 issues a YES signal 428 to a finish print job step 430, in response to which the printer 20 remains at idle, awaiting the next print job.

It is apparent that the factory tolerance adjust routine 200 and the printing routine 300 are discussed herein by way of example only, and may be varied in their individual steps or sequencing an still fall within the scope of the claims below. For example, in FIG. 18, when transitioning between the end of the print routine 380 and the beginning of the discharge routine 400, steps 396 and 402 may be combined or totally omitted. Indeed, the speed of data processing and printing would likely be improved and thus preferred if the information freely flowed from one portion of the process to the next with minimal impediments. The use of the begin routine and finish routine steps, among others, in the flow chart is primarily for clarity in helping the reader better understand the entire process by breaking it down into smaller segments. Such streamlining modifications to the illustrated information flow process are apparent to those skilled in the art, and clearly fall within the scope of the claims below. Thus, practice of the claimed invention is not limited to the embodiments illustrated herein.

Conclusion

For simplicity, and minimization of parts, the illustrated embodiment of the adaptive transport system 60 is preferred. Moreover, the fewer number of parts used in transport system 60, here, approximately seven moving gear parts as opposed to seventeen parts in the earlier designs, necessarily provides a quieter operating mechanism due to less interaction of gears and components. Furthermore, the lesser number of components in system 60 renders this system more economical to produce, as a fewer number of parts need to be procured, and then less labor time is required to assembled the parts. Moreover, the PPS adjust routine advantageously provides for automatable factory or service calibration of the PPS adjustment without requiring clumsy access panels, and which remains secure during shipping.

It is apparent that while the illustrated embodiment has been shown with respect to a replaceable inkjet cartridge, the principles of the adaptive transport system 60 may be applied to what is known in the art as an "off-axis" ink delivery system, where the main ink reservoir is stored at a stationary location for delivery to the reciprocating printhead, via flexible conduits or tubing, for instance. It is also apparent that the principles of the adaptive transport system 60 may be applied to what is known in the art as a "page-wide" printhead array, where the printhead extends over the entire width of the page, so reciprocation is unnecessary. In such a page-wide array printing mechanism, the clutch mechanism may be operated by a small solenoid, or through cooperation with one of the service station components.

Advantageously, operation of the adaptive transport system 60 allows for automatic adjustment of pen-to-paper spacing in response to the type and thickness of media being used to provide the best print quality. As a further advantage, the pen-to-paper spacing may also be adapted in response to the type of image being printed. For text or other minimal fill images, the spacing may be close to provide a crisper, cleaner image. For heavily filled images, such as charts, graphics or photographic images, that saturate the media with ink, the spacing may be increased to accommodate paper cockle, avoiding collision between the media and the printhead.

I claim:

1. An adaptive method of handling inkjet print media to accurately move the media into a printzone for receiving an image printed thereon by an inkjet printhead of an inkjet printing mechanism, the method comprising the steps of:

providing a drive motor, a media support member that defines a printhead-to-media spacing in the printzone between the printhead and media when supported thereby, providing a media advance mechanism having a media engaging member, providing a fresh supply of media with a media lifter thereunder, and providing a spacing adjuster;

operatively coupling the drive motor to the support member using the spacing adjuster;

following the coupling step, selectively adjusting printhead-to-media spacing by driving the spacing adjuster with the drive motor;

picking a first sheet from the fresh supply of media by bringing said first sheet into engagement with the media engaging member by the driving spacing adjuster with the motor to elevate the media lifter; and following the picking step, advancing media through the printzone;

by driving the media engaging member with the motor; and printing said image on the media when in the printzone using the printhead.

2. An adaptive method according to claim 1 wherein:

the method further includes the step of determining the amount of ink saturation of an image to be printed; and the adjusting step comprises adjusting the printhead-to-media spacing in response to the determining step.

3. An adaptive method according to claim 1 wherein:

the method further includes the step of determining the thickness of media to be printed; and the adjusting step comprises adjusting the printhead-to-media spacing in response to the determining step.

4. An adaptive method according to claim 3 wherein:

the method further includes the step of printing an image with the printhead onto media when in the printzone;

the determining step determines whether the media to be printed is of uniform or nonuniform thickness;

the adjusting step occurs prior to the printing step to adjust the printhead-to-media spacing to an initial first spacing; and when the determining step determines the media is of a nonuniform thickness, prior to printing at the nonuniform thickness, interrupting the printing step and repeating the adjusting step to readjust the printhead-to-media spacing to a selected second spacing.

5. An adaptive method according to claim 1 wherein:

the providing step comprises providing a reciprocating carriage that propels the printhead across the printzone, a clutch mechanism, and an adjuster drive member coupled to the spacing adjuster;

the operatively coupling step comprises the steps of engaging the clutch mechanism with the carriage, and in response thereto, moving the adjuster drive member into operative engagement with the motor to couple the spacing adjuster with the motor.

6. An adaptive method according to claim 5 wherein:

the providing step comprises providing an adjuster drive member comprising an adjuster gear having a first set of teeth and a second set of teeth adjacent a lost motion region, and a transfer gear driven by the motor and selectively engageable with the adjuster gear; and the step of moving the adjuster drive member into operative engagement with the motor comprises engaging the second set of teeth of the adjuster gear with the transfer gear.

7. An adaptive method according to claim 6 wherein:

following the adjusting step, the method further includes the step of disengaging the adjuster gear from the motor by moving the adjuster gear so the transfer gear rotates in the lost motion region; and the method further includes the step of printing an image with the printhead onto media when in the printzone, with the printing step beginning after the disengaging step.

8. An adaptive method according to claim 1 further including the steps of:

printing an image with the printhead onto media when in the printzone; and following the printing step, discharging the printed media from the printzone by driving the media engaging member with the motor.

9. An adaptive method of handling inkjet print media to accurately move the media into a printzone for receiving an image printed thereon by an inkjet printhead of an inkjet printing mechanism, the method comprising the steps of:

providing a drive motor, a media support member that defines a printhead-to-media spacing in the printzone between the printhead and media when supported thereby, providing a fresh supply of media with a media lifter thereunder, providing a media advance mechanism having a media engaging member, providing a spacing adjuster, and providing a controller having a memory portion with a tolerance adjust value stored therein;

selecting a desired printhead-to-media spacing and selecting an adjustment amount to drive the motor that corresponds to the desired printhead-to-media spacing;

summing the tolerance adjust value and the selected adjustment amount to drive the motor to arrive at a total motor drive value;

operatively coupling the drive motor to the support member using the spacing adjuster;

following the coupling step, selectively adjusting printhead-to-media spacing by driving the spacing adjuster with the drive motor for the total motor drive value;

following the adjusting step, advancing media through the printzone and printing an image on the media when in the printzone using the printhead;

picking a first sheet from the fresh supply of media by bringing said first sheet into engagement with the media engaging member by the driving spacing adjuster with the motor to elevate the media lifter; and following the picking step, advancing the media through the printzone by driving the media engaging member with the motor.

10. An adaptive method according to claim 9 wherein:

the method further includes the step of determining the amount of ink saturation of an image to be printed; and the step of selecting a desired printhead-to-media spacing is responsive to the step of determining the image to be printed.

11. An adaptive method according to claim 9 wherein:

the method further includes the step of determining the thickness of media to be printed; and the step of selecting a desired printhead-to-media spacing is responsive to the step of determining the thickness of media to be printed.

12. An adaptive method according to claim 9 further including the steps of:

printing an image with the printhead onto media when in the printzone; and following the printing step, discharging the printed media from the printzone by driving the media engaging member with the motor.

13. An adaptive method according to claim 9 wherein:

the method further includes the step of determining whether the media to be printed is of uniform or nonuniform thickness;

the adjusting step comprises adjusting the printhead-to-media spacing in response to the determining step prior to the printing step to adjust the printhead-to-media spacing to an initial first spacing;

the method further includes the step of printing an image with the printhead onto media when in the printzone; and when the determining step determines the media is of a nonuniform thickness, prior to printing at a nonuniform thickness, interrupting the printing step and repeating the adjusting step to readjust the printhead-to-media spacing to a selected second spacing.

* * * * *